US012622561B2

(12) United States Patent
Innes et al.

(10) Patent No.: US 12,622,561 B2
(45) Date of Patent: May 12, 2026

(54) VACUUM CLEANER AND DOCKING STATION FOR USE WITH THE SAME

(71) Applicant: SharkNinja Operating LLC, Needham, MA (US)

(72) Inventors: Daniel J. Innes, West Roxbury, MA (US); Andre D. Brown, Natick, MA (US); Jason B. Thorne, Dover, MA (US); Kai Xu, Suzhou (CN); Sam Liu, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 19/345,536

(22) Filed: Sep. 30, 2025

(65) Prior Publication Data

US 2026/0026668 A1 Jan. 29, 2026

Related U.S. Application Data

(63) Continuation of application No. 18/662,809, filed on May 13, 2024, which is a continuation of application (Continued)

(51) Int. Cl.
*A47L 11/40* (2006.01)
*A47L 9/12* (2006.01)

(Continued)

(52) U.S. Cl.
CPC ..... *A47L 11/4025* (2013.01); *A47L 9/12* (2013.01); *A47L 9/20* (2013.01); *A47L 9/2873* (2013.01);

(Continued)

(58) Field of Classification Search
CPC ..... A47L 9/20; A47L 11/4026; A47L 9/12; A47L 9/2873; A47L 11/4033;

(Continued)

(56) References Cited

U.S. PATENT DOCUMENTS 1,940,609 A 12/1933 Simpson
D96,138 S 7/1935 Scott (Continued)

FOREIGN PATENT DOCUMENTS

CA 161428 A 3/1915
CA 2495053 A1 2/2004

(Continued)

OTHER PUBLICATIONS

"Ovation HT107 Cordless Folding 2-in-1 Upright and Handheld Stick Vac Vacuum Cleaner with 180 Swivel Steering System", www.amazon.co.uk/Ovation-Cordless-Handheld-Steering-Upholstery, Jan. 14, 2019, 7 pages.

(Continued)

*Primary Examiner* — Katina N. Henson
(74) *Attorney, Agent, or Firm* — Knobbe, Martens, Olson & Bear, LLP

(57) ABSTRACT

A docking station for a vacuum cleaner may include a receptacle configured to engage at least a portion of the vacuum cleaner such that, in response to engaging the receptacle, a vacuum cleaner flow path extending within the vacuum cleaner is transitioned from a cleaning flow path to an evacuation flow path, a suction motor of the vacuum cleaner being configured to urge air along the vacuum cleaner flow path and a docking station dust cup configured to receive debris from a vacuum cleaner dust cup of the vacuum cleaner.

20 Claims, 16 Drawing Sheets

Related U.S. Application Data

No. 16/864,538, filed on May 1, 2020, now Pat. No. 11,998,150.

(60) Provisional application No. 62/841,548, filed on May 1, 2019.

(51) Int. Cl.

| | |
|---|---|
| ***A47L 9/20*** | (2006.01) |
| ***A47L 9/28*** | (2006.01) |
| *A47L 9/10* | (2006.01) |
| *A47L 9/14* | (2006.01) |

(52) U.S. Cl.

CPC ..... *A47L 11/4033* (2013.01); *A47L 11/4091* (2013.01); *A47L 9/106* (2013.01); *A47L 9/149* (2013.01); *A47L 2201/024* (2013.01)

(58) Field of Classification Search

CPC .. A47L 11/4025; A47L 11/4091; A47L 9/106; A47L 9/149; A47L 2201/024; B01D 46/681; B01D 46/52; E01H 1/0845

USPC ..... 15/352

See application file for complete search history.

(56) References Cited

U.S. PATENT DOCUMENTS

| | | | |
|---|---|---|---|
| 2,133,141 | A | 10/1938 | Holm-Hansen |
| 2,149,135 | A | 2/1939 | Eriksson-Jons |
| 2,477,685 | A | 8/1949 | Brown, Jr. |
| 3,954,426 | A | 5/1976 | Brange |
| 4,209,875 | A | 7/1980 | Pugh et al. |
| D273,146 | S | 3/1984 | Farr |
| 4,473,923 | A | 10/1984 | Neroni et al. |
| 4,573,234 | A | 3/1986 | Kochte et al. |
| 4,745,654 | A | 5/1988 | Yamamoto et al. |
| 4,894,882 | A | 1/1990 | Toya |
| D315,043 | S | 2/1991 | Hayden |
| 5,020,187 | A | 6/1991 | Kosten et al. |
| 5,107,567 | A | 4/1992 | Ferrari et al. |
| D333,023 | S | 2/1993 | Herron, Jr. |
| D334,447 | S | 3/1993 | Rohn |
| 5,198,111 | A | 3/1993 | Davis |
| 5,224,237 | A | 7/1993 | Ambrosiano |
| 5,267,371 | A | 12/1993 | Soler et al. |
| 5,379,483 | A | 1/1995 | Pino |
| 5,561,885 | A | 10/1996 | Zahuranec et al. |
| 5,584,095 | A | 12/1996 | Redding et al. |
| 5,659,922 | A | 8/1997 | Louis |
| 5,794,305 | A | 8/1998 | Weger |
| 5,926,909 | A | 7/1999 | McGee |
| D419,731 | S | 1/2000 | Bates et al. |
| 6,055,703 | A | 5/2000 | Redding et al. |
| 6,108,864 | A | 8/2000 | Thomas et al. |
| D431,335 | S | 9/2000 | Mehaffey et al. |
| 6,122,796 | A | 9/2000 | Downham et al. |
| 6,295,692 | B1 | 10/2001 | Shideler |
| 6,317,921 | B1 | 11/2001 | Park et al. |
| 6,459,955 | B1 | 10/2002 | Bartsch et al. |
| 6,485,536 | B1 | 11/2002 | Masters |
| 6,493,903 | B1 | 12/2002 | Super |
| 6,572,668 | B1 | 6/2003 | An et al. |
| D485,364 | S | 1/2004 | Lee |
| 6,766,558 | B1 | 7/2004 | Matsumoto et al. |
| 6,829,804 | B2 | 12/2004 | Sepke |
| D510,066 | S | 9/2005 | Hickey et al. |
| D510,465 | S | 10/2005 | Takahashi et al. |
| 6,991,666 | B2 | 1/2006 | Organ |
| 7,003,846 | B2 | 2/2006 | Holtz |
| 7,059,012 | B2 | 6/2006 | Song et al. |
| 7,163,568 | B2 | 1/2007 | Sepke et al. |
| D543,325 | S | 5/2007 | Burnham |
| 7,288,129 | B2 | 10/2007 | Oh et al. |
| 7,294,159 | B2 | 11/2007 | Oh et al. |
| D565,266 | S | 3/2008 | Crevling et al. |
| D573,759 | S | 7/2008 | Konno et al. |
| 7,412,748 | B2 | 8/2008 | Lee et al. |
| 7,412,749 | B2 | 8/2008 | Thomas et al. |
| 7,422,614 | B2 | 9/2008 | Sepke et al. |
| D580,116 | S | 11/2008 | Santiago et al. |
| D587,870 | S | 3/2009 | Baek et al. |
| 7,503,098 | B2 | 3/2009 | Stein |
| 7,507,269 | B2 | 3/2009 | Murphy et al. |
| 7,581,284 | B2 | 9/2009 | Courtney |
| 7,581,285 | B2 | 9/2009 | Courtney |
| 7,600,292 | B2 | 10/2009 | Courtney |
| 7,610,653 | B2 | 11/2009 | Courtney |
| 7,628,832 | B2 | 12/2009 | Sepke et al. |
| D608,064 | S | 1/2010 | Conrad et al. |
| D611,210 | S | 3/2010 | Conrad et al. |
| 7,757,343 | B2 | 7/2010 | Courtney |
| 7,785,381 | B2 | 8/2010 | Oh et al. |
| 7,805,804 | B2 | 10/2010 | Loebig |
| 7,823,251 | B2 | 11/2010 | Dyson et al. |
| 7,849,555 | B2 | 12/2010 | Hahm et al. |
| 7,854,039 | B2 | 12/2010 | Lee et al. |
| D633,264 | S | 2/2011 | Lee |
| 7,882,593 | B2 | 2/2011 | Beskow et al. |
| 7,951,214 | B2 | 5/2011 | Menrik et al. |
| D639,237 | S | 6/2011 | Lee et al. |
| D639,735 | S | 6/2011 | Lee et al. |
| D640,194 | S | 6/2011 | Kim et al. |
| 7,958,597 | B2 | 6/2011 | Frantzen et al. |
| D641,114 | S | 7/2011 | Choi et al. |
| D642,755 | S | 8/2011 | Fjellman |
| D644,385 | S | 8/2011 | Hare et al. |
| D645,403 | S | 9/2011 | Seo et al. |
| 8,021,453 | B2 | 9/2011 | Howes |
| 8,032,983 | B2 | 10/2011 | Griffith et al. |
| 8,069,529 | B2 | 12/2011 | Groff et al. |
| 8,156,609 | B2 | 4/2012 | Milne et al. |
| 8,163,051 | B2 | 4/2012 | Yun et al. |
| D659,923 | S | 5/2012 | Dyson |
| D662,271 | S | 6/2012 | Conrad et al. |
| D662,272 | S | 6/2012 | Conrad et al. |
| D670,056 | S | 10/2012 | Ventress et al. |
| D670,458 | S | 11/2012 | Seo et al. |
| D675,154 | S | 1/2013 | Nam et al. |
| 8,387,204 | B2 | 3/2013 | Dyson |
| D680,288 | S | 4/2013 | Bilger et al. |
| 8,424,154 | B2 | 4/2013 | Beskow et al. |
| D681,894 | S | 5/2013 | Wu et al. |
| 8,444,731 | B2 | 5/2013 | Gomiciaga-Pereda et al. |
| D684,326 | S | 6/2013 | Okabe et al. |
| D685,961 | S | 7/2013 | Bilger et al. |
| D686,377 | S | 7/2013 | Thorne |
| 8,533,907 | B2 | 9/2013 | Eccardt et al. |
| D691,553 | S | 10/2013 | Deoksang et al. |
| 8,549,704 | B2 | 10/2013 | Milligan et al. |
| D693,975 | S | 11/2013 | Santiago et al. |
| D695,980 | S | 12/2013 | Thorne |
| 8,595,894 | B1 | 12/2013 | Kakish |
| 8,607,406 | B2 | 12/2013 | Miefalk et al. |
| 8,607,407 | B2 | 12/2013 | Conrad |
| D698,310 | S | 1/2014 | Yun et al. |
| 8,635,739 | B2 | 1/2014 | Lee et al. |
| 8,640,304 | B2 | 2/2014 | Conrad |
| 8,660,736 | B2 | 2/2014 | Chen et al. |
| 8,661,608 | B2 | 3/2014 | Knopow et al. |
| 8,695,157 | B2 | 4/2014 | Beskow et al. |
| 8,769,764 | B2 | 7/2014 | Crouch et al. |
| 8,806,702 | B2 | 8/2014 | Wolfe et al. |
| 8,918,947 | B2 | 12/2014 | Schwartz |
| 8,955,193 | B2 | 2/2015 | Ha et al. |
| 9,134,733 | B2 | 9/2015 | Yoo et al. |
| 9,141,110 | B2 | 9/2015 | Yoo et al. |
| D743,125 | S | 11/2015 | Lee et al. |
| 9,211,046 | B2 | 12/2015 | Peace |
| 9,271,618 | B2 | 3/2016 | Mantyla et al. |
| 9,295,363 | B1 | 3/2016 | Conrad |
| 9,301,666 | B2 | 4/2016 | Conrad |
| D762,932 | S | 8/2016 | Ventress et al. |
| D764,125 | S | 8/2016 | Palladino et al. |

(56) References Cited

U.S. PATENT DOCUMENTS 9,462,920 B1 10/2016 Morin et al.
9,499,134 B2 11/2016 Amber
9,526,391 B2 12/2016 Lee et al.
9,545,180 B2 1/2017 Conrad
9,545,181 B2 1/2017 Conrad
D779,753 S 2/2017 Mikula et al.
D782,412 S 3/2017 Kim et al.
9,591,952 B2 3/2017 Conrad
D789,634 S 6/2017 Witter et al.
9,668,624 B2 6/2017 Conrad
9,668,630 B2 6/2017 Conrad
D796,133 S 8/2017 Larouche
D796,135 S 8/2017 Yoon et al.
9,717,383 B2 8/2017 Conrad
9,775,479 B2 10/2017 Conrad
9,775,480 B2 10/2017 Conrad
9,775,481 B2 10/2017 Conrad
9,788,698 B2 10/2017 Morin et al.
9,795,264 B2 10/2017 Thorne et al.
D801,923 S 11/2017 Minamide et al.
9,808,135 B2 11/2017 Mantyla et al.
9,826,873 B2 11/2017 Abe et al.
D805,267 S 12/2017 Maune
9,883,781 B2 2/2018 Thorne et al.
9,901,229 B2 2/2018 Thorne et al.
D812,829 S 3/2018 Shin et al.
9,980,620 B2 5/2018 Sjberg
10,022,027 B2 7/2018 Conrad
10,080,472 B2 9/2018 Conrad
10,117,550 B1 11/2018 Conrad
10,136,778 B2 11/2018 Conrad
10,244,910 B2 4/2019 Conrad
10,327,607 B2 6/2019 Conrad
D854,767 S 7/2019 Bond
10,357,136 B2 7/2019 Conrad
10,405,710 B2 9/2019 Conrad et al.
10,433,687 B2 10/2019 Dimbylow
10,447,048 B2 10/2019 Petzold
10,512,381 B2 12/2019 Meggle et al.
D873,516 S 1/2020 Palladino et al.
10,568,477 B2 2/2020 Conrad
D891,014 S 7/2020 Chu
D898,219 S 10/2020 Xie
10,791,891 B2 10/2020 Kuhe et al.
10,952,578 B2 3/2021 Gill et al.
11,013,378 B2 5/2021 Conrad
11,013,382 B2 5/2021 Hwang et al.
11,013,383 B2 5/2021 Conrad
D923,888 S 6/2021 Liu
D937,514 S 11/2021 Zou
D938,675 S 12/2021 Burgess et al.
11,202,544 B2 12/2021 Conrad
11,213,177 B2 1/2022 Tonderys et al.
D942,721 S 2/2022 Yoon et al.
D943,848 S 2/2022 Liu
D945,094 S 3/2022 Jeon et al.
D948,817 S 4/2022 Zou
11,350,806 B2 6/2022 Terry et al.
11,375,861 B2 7/2022 Conrad
D961,868 S 8/2022 Lin
D963,268 S 9/2022 Zheng
D965,239 S 9/2022 Chen
11,439,285 B2 9/2022 Conrad et al.
D967,573 S 10/2022 Jiang et al.
D971,533 S 11/2022 Thompson et al.
11,607,096 B2 3/2023 Sergyeyenko et al.
11,641,995 B2 5/2023 Conrad
11,647,863 B2 5/2023 Conrad et al.
D988,623 S 6/2023 Xu
11,672,388 B2 6/2023 Tonderys et al.
11,672,395 B2 6/2023 Conrad
11,672,397 B2 6/2023 Conrad
D993,554 S 7/2023 Ren et al.
D993,555 S 7/2023 Ren et al.
D995,016 S 8/2023 Johnson
D995,019 S 8/2023 Johnson et al.
D998,917 S 9/2023 Lee et al.
11,786,095 B2 10/2023 Conrad
11,864,714 B2 1/2024 Tonderys et al.
D1,014,881 S 2/2024 Li et al.
D1,015,660 S 2/2024 Palladino et al.
D1,015,661 S 2/2024 Abe et al.
11,930,987 B2 3/2024 Conrad
11,930,988 B2 3/2024 Tonderys et al.
D1,021,304 S 4/2024 Tang et al.
11,998,150 B2 6/2024 Innes et al.
12,029,375 B2 7/2024 Tonderys et al.
12,035,875 B2 7/2024 Conrad
12,096,884 B2 9/2024 Conrad et al.
D1,052,204 S 11/2024 Zhong
12,137,866 B2 11/2024 Yang et al.
D1,075,200 S 5/2025 Hu
D1,078,202 S 6/2025 Johnson et al.
12,336,681 B2 6/2025 Tonderys et al.
D1,091,986 S 9/2025 Xue
D1,114,439 S 2/2026 Palladino et al.
2002/0166199 A1* 11/2002 Boles ..... A47L 9/127 55/300
2002/0184731 A1* 12/2002 Moine ..... A47L 9/14 15/352
2004/0187253 A1 9/2004 Jin et al.
2004/0216264 A1 11/2004 Shaver et al.
2004/0237482 A1 12/2004 Lim et al.
2004/0261212 A1 12/2004 Park et al.
2005/0081321 A1 4/2005 Milligan et al.
2005/0086762 A1 4/2005 Paris
2005/0102982 A1 5/2005 Dummelow et al.
2005/0132528 A1 6/2005 Yau
2005/0198769 A1 9/2005 Lee et al.
2005/0229554 A1 10/2005 Oh et al.
2006/0026788 A1 2/2006 Fischer et al.
2006/0090290 A1 5/2006 Lau
2006/0137309 A1 6/2006 Jeong et al.
2006/0156508 A1 7/2006 Khalil
2006/0162117 A1 7/2006 Thomas et al.
2007/0186522 A1 8/2007 Hato
2007/0209335 A1 9/2007 Conrad
2007/0271724 A1 11/2007 Hakan et al.
2008/0040883 A1 2/2008 Beskow et al.
2008/0189901 A1 8/2008 Jansen
2008/0201895 A1 8/2008 Kim et al.
2008/0260601 A1 10/2008 Lyon
2009/0056058 A1 3/2009 Finke et al.
2009/0056059 A1 3/2009 Mersmann et al.
2009/0056061 A1 3/2009 Andrup et al.
2009/0144931 A1 6/2009 Milligan et al.
2009/0205491 A1 8/2009 Eckstein et al.
2009/0288268 A1 11/2009 Courtney
2010/0115726 A1 5/2010 Groff et al.
2010/0293745 A1 11/2010 Coburn
2011/0107553 A1 5/2011 Myers
2011/0219581 A1 9/2011 Mnes et al.
2011/0289720 A1 12/2011 Han et al.
2011/0314630 A1 12/2011 Conrad
2013/0031742 A1 2/2013 Miefalk et al.
2013/0058635 A1 3/2013 Vrdoljak
2013/0152337 A1 6/2013 Thorne
2013/0305481 A1 11/2013 Jung et al.
2013/0335900 A1 12/2013 Jang
2014/0129170 A1 5/2014 Ramachandran et al.
2014/0137364 A1 5/2014 Stickney et al.
2014/0150201 A1 6/2014 Mcgee et al.
2014/0237754 A1 8/2014 Conrad
2014/0237762 A1 8/2014 Conrad
2014/0259519 A1 9/2014 Conrad et al.
2015/0013102 A1 1/2015 Bilger
2015/0040340 A1 2/2015 Bilger et al.
2015/0135470 A1 5/2015 Mantyla et al.
2015/0135474 A1 5/2015 Gidwell
2015/0196859 A1 7/2015 Levitt
2015/0223651 A1 8/2015 Kuhe et al.
2015/0230677 A1 8/2015 Andrikanish
2015/0289733 A1 10/2015 Rowntree
2015/0297054 A1 10/2015 Weeks et al.

(56) References Cited

U.S. PATENT DOCUMENTS

2015/0351596 A1 12/2015 Thorne
2016/0106284 A1 4/2016 Mantyla et al.
2016/0128530 A1 5/2016 Thorne et al.
2016/0150923 A1 6/2016 Conrad
2016/0166126 A1 6/2016 Morin et al.
2016/0174787 A1 6/2016 Conrad
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0374528 A1 12/2016 Morin et al.
2016/0374533 A1 12/2016 Innes et al.
2017/0000305 A1 1/2017 Gordon et al.
2017/0001136 A1 1/2017 Hensel et al.
2017/0020351 A1 1/2017 Fredrik
2017/0042319 A1 2/2017 Conrad et al.
2017/0079489 A1 3/2017 Dimbylow
2017/0105591 A1 4/2017 Bernhard-Tanis
2017/0112343 A1 4/2017 Innes et al.
2017/0127896 A1 5/2017 Carter et al.
2017/0144810 A1 5/2017 Birdsell
2017/0188763 A1 7/2017 Hu
2017/0196420 A1 7/2017 Brown et al.
2017/0202413 A1 7/2017 Tan
2017/0209010 A1 7/2017 Peters
2017/0215667 A1 8/2017 Thorne et al.
2017/0332860 A1* 11/2017 Nam ..... A47L 9/32
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0078107 A1 3/2018 Gagnon et al.
2018/0177358 A1 6/2018 Conrad
2018/0177363 A1 6/2018 Ni
2018/0177366 A1 6/2018 Conrad
2018/0228335 A1 8/2018 Miller
2018/0255991 A1 9/2018 Der et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0125153 A1 5/2019 Loveless et al.
2019/0191947 A1 6/2019 Freese et al.
2019/0193120 A1 6/2019 Brown et al.
2019/0200824 A1 7/2019 Campbell-Hill
2019/0246853 A1 8/2019 Sardar et al.
2019/0274500 A1 9/2019 Thorne et al.
2019/0274501 A1 9/2019 Antonisami et al.
2019/0282051 A1 9/2019 Conrad et al.
2019/0290084 A1 9/2019 Conrad
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037836 A1 2/2020 Paulla et al.
2020/0037843 A1 2/2020 Fiebig et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0230617 A1 7/2020 Conrad
2020/0230619 A1 7/2020 Conrad
2020/0237171 A1 7/2020 Xu et al.
2020/0253437 A1 8/2020 Conrad et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0329909 A1 10/2020 Conrad et al.
2020/0345196 A1 11/2020 Innes et al.
2020/0367711 A1 11/2020 Thorne et al.
2020/0371526 A1 11/2020 Kamada
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0045600 A1 2/2021 Schmitz et al.
2021/0052121 A1 2/2021 Kim et al.
2021/0059495 A1 3/2021 Gill et al.
2021/0085144 A1 3/2021 Woodrow et al.
2021/0169289 A1 6/2021 Thorne et al.
2021/0175772 A1 6/2021 Aini
2021/0177223 A1 6/2021 Der et al.
2021/0186282 A1 6/2021 Mathieu et al.
2021/0204684 A1 7/2021 Heman-Ackah et al.
2021/0235947 A1 8/2021 Ni
2021/0254615 A1 8/2021 Vrdoljak et al.
2021/0290019 A1 9/2021 Tonderys et al.
2021/0290020 A1 9/2021 Tonderys et al.
2021/0307581 A1 10/2021 Thorne et al.
2021/0315428 A1 10/2021 Udy et al.
2021/0386261 A1 12/2021 Woodrow et al.
2021/0386262 A1 12/2021 Uchendu et al.
2022/0007904 A1 1/2022 Conrad
2022/0015593 A1 1/2022 Conrad
2022/0022712 A1 1/2022 Gadient et al.
2022/0031131 A1 2/2022 Mcclay et al.
2022/0031133 A1 2/2022 Der et al.
2022/0031134 A1 2/2022 Yang et al.
2022/0039622 A1 2/2022 Kim et al.
2022/0047133 A1 2/2022 Sergyeyenko et al.
2022/0061614 A1 3/2022 Yu et al.
2022/0071459 A1 3/2022 Gacin et al.
2022/0095864 A1 3/2022 Der et al.
2022/0125256 A1 4/2022 Lessard et al.
2022/0142404 A1 5/2022 Conrad et al.
2022/0142440 A1 5/2022 Conrad
2022/0175206 A1 6/2022 Li et al.
2022/0211233 A1 7/2022 Conrad
2022/0287521 A1 9/2022 Cottrell et al.
2022/0304531 A1 9/2022 Guo et al.
2022/0322903 A1 10/2022 Lessard
2022/0338691 A1 10/2022 Conrad et al.
2022/0369875 A1 11/2022 Conrad
2022/0400922 A1 12/2022 Mcclay et al.
2022/0408994 A1 12/2022 Hill
2023/0029837 A1 2/2023 Hwang et al.
2023/0043567 A1 2/2023 Copeland et al.
2023/0060356 A1 3/2023 Jiang et al.
2023/0070147 A1 3/2023 Harting et al.
2023/0117115 A1 4/2023 Choi et al.
2023/0148812 A1 5/2023 Yang et al.
2023/0157495 A1 5/2023 Copeland et al.
2023/0172407 A1 6/2023 Conrad
2023/0225577 A1 7/2023 Conrad
2023/0248192 A1 8/2023 Brown et al.
2023/0263350 A1 8/2023 Conrad et al.
2023/0329502 A1 10/2023 Chirikjian

(56) References Cited

U.S. PATENT DOCUMENTS

| | | | |
|---|---|---|---|
| 2024/0057831 | A1 | 2/2024 | Conrad |
| 2024/0065497 | A1 | 2/2024 | Tonderys et al. |
| 2024/0292992 | A1 | 9/2024 | Innes et al. |
| 2024/0315503 | A1 | 9/2024 | Tonderys et al. |
| 2024/0315517 | A1 | 9/2024 | Conrad |
| 2024/0389815 | A1 | 11/2024 | Conrad |
| 2024/0415326 | A1 | 12/2024 | Conrad et al. |
| 2024/0415352 | A1 | 12/2024 | Mcclay et al. |
| 2025/0040774 | A1 | 2/2025 | Yang et al. |
| 2025/0151962 | A1 | 5/2025 | Tonderys et al. |
| 2025/0275656 | A1 | 9/2025 | Conrad |
| 2026/0033681 | A1 | 2/2026 | Tonderys et al. |

FOREIGN PATENT DOCUMENTS

| | | | |
|---|---|---|---|
| CA | 2915198 | C | 5/2018 |
| CA | 3145603 | A1 | 4/2019 |
| CA | 2952664 | C | 5/2019 |
| CA | 185936 | S | 3/2022 |
| CA | 3076938 | C | 3/2022 |
| CH | 203675 | A | 3/1939 |
| CN | 1319372 | A | 10/2001 |
| CN | 101061932 | A | 10/2007 |
| CN | 201299513 | Y | 9/2009 |
| CN | 101801252 | A | 8/2010 |
| CN | 202173358 | U | 3/2012 |
| CN | 202776167 | U | 3/2013 |
| CN | 105708389 | A | 6/2016 |
| CN | 106923739 | A | 7/2017 |
| CN | 106923745 | A | 7/2017 |
| CN | 106963286 | A | 7/2017 |
| CN | 206295328 | U | 7/2017 |
| CN | 106998972 | A | 8/2017 |
| CN | 107049138 | A | 8/2017 |
| CN | 207152536 | U | 3/2018 |
| CN | 107913030 | A | 4/2018 |
| CN | 107928544 | A | 4/2018 |
| CN | 208211971 | U | 12/2018 |
| CN | 109602326 | A | 4/2019 |
| CN | 209826545 | U | 12/2019 |
| CN | 210354542 | U | 4/2020 |
| CN | 111466820 | A | 7/2020 |
| CN | 211093737 | U | 7/2020 |
| CN | 211324705 | U | 8/2020 |
| CN | 211609590 | U | 10/2020 |
| CN | 211862669 | U | 11/2020 |
| CN | 212015446 | U | 11/2020 |
| CN | 212037365 | U | 12/2020 |
| CN | 212234298 | U | 12/2020 |
| CN | 212661752 | U | 3/2021 |
| CN | 212879123 | U | 4/2021 |
| CN | 213155648 | U | 5/2021 |
| CN | 113317716 | A | 8/2021 |
| CN | 216135772 | U | 3/2022 |
| CN | 118973457 | A | 11/2024 |
| DE | 2401429 | A1 | 7/1974 |
| DE | 102012100050 | A1 | 7/2013 |
| DE | 102012109938 | A1 | 4/2014 |
| DE | 102015100057 | A1 | 7/2016 |
| DE | 102019004417 | A1 | 12/2020 |
| EP | 0008117 | A1 | 2/1980 |
| EP | 0215165 | A1 | 3/1987 |
| EP | 1199023 | A1 | 4/2002 |
| EP | 1523916 | A2 | 4/2005 |
| EP | 1652457 | A1 | 5/2006 |
| EP | 1969988 | A2 | 9/2008 |
| EP | 1977672 | A1 | 10/2008 |
| EP | 3195778 | A1 | 7/2017 |
| EP | 4326128 | A1 | 2/2024 |
| EP | 4468928 | A1 | 12/2024 |
| ES | 2238196 | A1 | 8/2005 |
| FR | 0497856 | A | 12/1919 |
| FR | 1094603 | A | 5/1955 |
| GB | 0194963 | A | 3/1923 |
| GB | 0283179 | A | 8/1928 |
| GB | 0482938 | A | 4/1938 |
| GB | 0539060 | A | 8/1941 |
| GB | 2035787 | A | 6/1980 |
| GB | 2155314 | A | 9/1985 |
| GB | 2372434 | A | 8/2002 |
| GB | 2385292 | A | 8/2003 |
| GB | 2399780 | A | 9/2004 |
| GB | 2413103 | A | 10/2005 |
| GB | 2468797 | A | 9/2010 |
| GB | 2539060 | B | 11/2017 |
| GB | 2629985 | A | 11/2024 |
| GB | 2616983 | B | 4/2025 |
| JP | 48-020449 | U | 3/1973 |
| JP | 49-025163 | Y2 | 7/1974 |
| JP | 53-145375 | U | 11/1978 |
| JP | 59-027063 | U | 2/1984 |
| JP | 60-008814 | B2 | 3/1985 |
| JP | 60-188124 | A | 9/1985 |
| JP | 61-222431 | A | 10/1986 |
| JP | 62-010850 | U | 1/1987 |
| JP | 62-142532 | A | 6/1987 |
| JP | 63-127734 | A | 5/1988 |
| JP | 63-129551 | A | 6/1988 |
| JP | 04-122336 | A | 4/1992 |
| JP | 1123785 | S | 10/2001 |
| JP | 2004-283327 | A | 10/2004 |
| JP | 2006-333925 | A | 12/2006 |
| JP | 2007-029230 | A | 2/2007 |
| JP | 2010-075399 | A | 4/2010 |
| JP | 2013-202212 | A | 10/2013 |
| JP | 2015-202410 | A | 11/2015 |
| JP | 2016-131777 | A | 7/2016 |
| JP | 2017-000395 | A | 1/2017 |
| JP | 2017-131547 | A | 8/2017 |
| JP | 6445023 | B2 | 12/2018 |
| JP | 6706715 | B2 | 6/2020 |
| JP | 2020-534090 | A | 11/2020 |
| JP | 1775973 | S | 7/2024 |
| KR | 86-0001634 | B1 | 10/1986 |
| KR | 93-0011949 | A | 7/1993 |
| KR | 10-2001-0027468 | A | 4/2001 |
| KR | 10-2005-0001766 | A | 1/2005 |
| KR | 10-2007-0094288 | A | 9/2007 |
| KR | 10-2012-0003054 | A | 1/2012 |
| KR | 10-2354485 | B1 | 1/2022 |
| WO | 02/67753 | A1 | 9/2002 |
| WO | 2006/008451 | A1 | 1/2006 |
| WO | 2007/084543 | A2 | 7/2007 |
| WO | 2007/117196 | A1 | 10/2007 |
| WO | 2008/009888 | A1 | 1/2008 |
| WO | 2013/071190 | A1 | 5/2013 |
| WO | 2014/113806 | A1 | 7/2014 |
| WO | 2016/095040 | A1 | 6/2016 |
| WO | 2016/146555 | A1 | 9/2016 |
| WO | 2016/192260 | A1 | 12/2016 |
| WO | 2018/176661 | A1 | 10/2018 |
| WO | 2019/060564 | A1 | 3/2019 |
| WO | 2019/068193 | A1 | 4/2019 |
| WO | 2020/122631 | A1 | 6/2020 |
| WO | 2020/223619 | A1 | 11/2020 |
| WO | 2021/177699 | A1 | 9/2021 |
| WO | 2022/010198 | A1 | 1/2022 |
| WO | 2022/026744 | A1 | 2/2022 |
| WO | 2022/147614 | A1 | 7/2022 |
| WO | 2022/221936 | A1 | 10/2022 |
| WO | 2023/018048 | A1 | 2/2023 |
| WO | 2023/141699 | A1 | 8/2023 |

OTHER PUBLICATIONS

"Introducing the slimmest vacuum cleaner—the 38 mm Dyson PencilVac", Dyson, Online available at <https://www.dyson.com/discover/innovation/new-machines/pencilvac-launch>, retrieved on Oct. 7, 2025, pp. 1-15.

Dyson DC07 Owner's Manual, (DC01Manual), 12 pages.

Dyson DC14 Owner's Manual, (DC14Manual), 16 pages.

International Preliminary Report on Patentability, re PCT Application No. PCT/US2018/051978, dated Apr. 2, 2020.

(56) References Cited

OTHER PUBLICATIONS

International Preliminary Report on Patentability, re PCT Application No. PCT/US2020/030991, dated Dec. 11, 2021.
International Preliminary Report on Patentability, re PCT Application No. PCT/US2021/043751, dated Feb. 9, 2023.
PCT International Search Report and Written Opinion mailed Dec. 7, 2018, received in corresponding PCT Application No. PCT/US18/51978, 10 pgs.
PCT Search Report and Written Opinion mailed Aug. 28, 2019, received in PCT Application No. PCT/US19/29796, 10 pgs.
PCT Search Report and Written Opinion mailed Jun. 1, 2023, received in PCT Application No. PCT/CN2022/118922, 12 pages.
PCT Search Report and Written Opinion mailed Nov. 4, 2021, received in corresponding PCT Application No. PCT/US21/43751, 9 pages.
PCT Search Report and Written Opinion, mailed Jul. 22, 2020, received in corresponding PCT Application No. PCT/ US2020/030991, 8 pages.
Shark W1, available in Amazon.co.uk, date 1st available Aug. 13, 2018[online], [site visited May 4, 2021, Available from internet URL: https://www.amazon.co.uk/Handheld-Lightweight-Powerful-Detachable-WV201/dp/B07FX5K4D6/ref=sr_1_3?dchild=1&keywords=Shark+W1%2C+Handheld+Vacuum&qid=1620182094&s=kitchen&sr=1-3 (Year: 2018).
Toshiba Corporation., Ltd., Catalog, No. 01-1, 2001 (Publicly known document No. HC13000398 of JPO Design Division) (English translation: not available), listed in JP Notice of References, received with JP Allowance dated May 15, 2018, 3 pgs.

* cited by examiner

VACUUM CLEANER AND DOCKING STATION FOR USE WITH THE SAME

CROSS-REFERENCE TO RELATED APPLICATIONS

This application is a continuation of U.S. patent application Ser. No. 18/662,809, filed May 13, 2024, which is a continuation of U.S. patent application Ser. No. 16/864,538, filed May 1, 2020, which claims priority to U.S. Provisional Patent Application No. 62/841,548 filed on May 1, 2019, entitled Docking Station for Vacuum Cleaner, which are incorporated herein by reference in their entireties. Any and all applications, if any, for which a foreign or domestic priority claim is identified in the Application Data Sheet of the present application is hereby incorporated by reference under 37 CFR 1.57.

TECHNICAL FIELD

The present disclosure is generally related to surface treatment apparatuses and more specifically related to vacuum cleaners and docking stations for use therewith.

BACKGROUND INFORMATION

Surface treatment apparatuses can include upright vacuum cleaners configured to be transitionable between a storage position and an in-use position. Upright vacuum cleaners can include a suction motor configured to draw air into an air inlet of the upright vacuum cleaner such that debris deposited on a surface can be urged into the air inlet. At least a portion of the debris urged into the air inlet can be deposited within a dust cup of the upright vacuum cleaner for later disposal.

BRIEF DESCRIPTION OF THE DRAWINGS

These and other features and advantages will be better understood by reading the following detailed description, taken together with the drawings, wherein.

DETAILED DESCRIPTION

The present disclosure is generally related to a docking station for use with a vacuum cleaner. An example docking station is configured to alter an airflow path within the vacuum cleaner such that airflow generated by a suction motor of the vacuum cleaner can be used to, for example, urge debris within a vacuum cleaner dust cup into a docking station dust cup. Evacuation of debris from the vacuum cleaner dust cup to the docking station dust cup, when at least a portion of the vacuum cleaner engages (e.g., contacts) the docking station, may allow the vacuum cleaner dust cup to have a decreased volume, which may reduce the size and/or weight of the vacuum cleaner.

Figure 1:
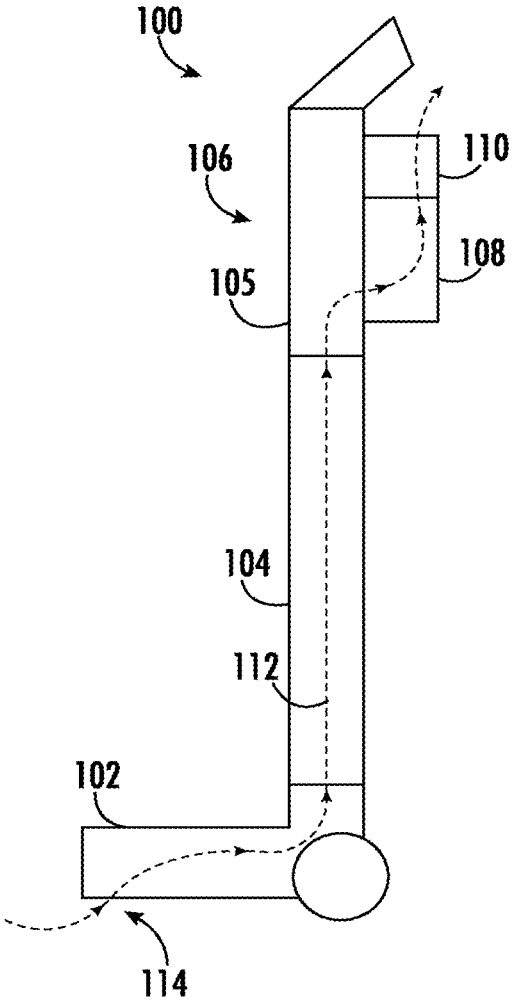
FIG. 1 is a schematic side view of an example of a vacuum cleaner, consistent with embodiments of the present disclosure.

FIG. 1 shows a schematic example of a vacuum cleaner 100. As shown, the vacuum cleaner 100 includes a surface cleaning head 102, a wand 105 coupled to a wand extension 104 such that the wand 105 and wand extension 104 are fluidly coupled to the surface cleaning head 102, and a vacuum assembly 106 fluidly coupled to the wand 105. The vacuum assembly 106 can include a vacuum cleaner dust cup 108 and a suction motor 110. The suction motor 110 is configured urge air along a cleaning flow path 112. The cleaning flow path 112 can extend from an inlet 114 of, for example, the surface cleaning head 102 through the wand extension 104 and the wand 105 into the vacuum cleaner dust cup 108 through suction motor 110 and into a surrounding environment.

The vacuum assembly 106 can be decoupled from the wand extension 104 such that the vacuum assembly 106 can be used independently from the wand extension 104 and/or surface cleaning head 102. For example, the vacuum assembly 106 can be configured to be coupled to additional vacuum cleaning accessories when decoupled from the wand extension 104 and/or the surface cleaning head 102. In some instances, the wand extension 104 and vacuum assembly 106 can be collectively decoupled from the surface cleaning head 102 such that the vacuum assembly 106 and wand extension 104 can be used independently of the surface cleaning head 102.

Figure 2:
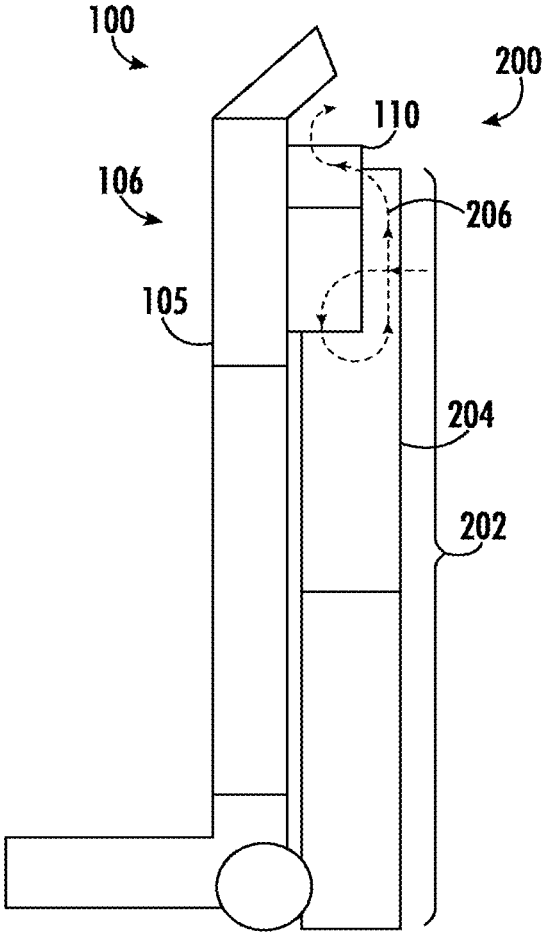
FIG. 2 is a schematic side view of an example of the vacuum cleaner of FIG. 1 engaging an example of a docking station, consistent with embodiments of the present disclosure.

FIG. 2 shows a schematic example of the vacuum cleaner 100 of FIG. 1 engaging (e.g., contacting) a docking station 200. The docking station 200 can include an upright section 202 and a docking station dust cup 204 coupled to the upright section 202 and configured to receive debris from the vacuum cleaner dust cup 108. When the vacuum cleaner 100 is brought into engagement with the docking station 200 (e.g., the vacuum assembly 106 is brought into engagement with the docking station 200), the cleaning flow path 112 of FIG. 1 is caused to transition into an evacuation flow path 206 by bypassing the wand extension 104 and the surface cleaning head 102. In other words, a vacuum cleaner flow path extending within the vacuum cleaner 100 (e.g., the vacuum assembly 106) is caused to transition from the cleaning flow path 112 to the evacuation flow path 206, wherein the suction motor 110 is configured to urge air to flow along the vacuum cleaner flow path. As shown, the evacuation flow path 206 extends from the vacuum cleaner dust cup 108 into the docking station dust cup 204 through the suction motor 110 and into the surrounding environment. As such, debris deposited within the vacuum cleaner dust cup 108 is urged into the docking station dust cup 204 using air flowing along the evacuation flow path 206, the airflow being generated by the suction motor 110 of the vacuum cleaner 100.

Figure 3:
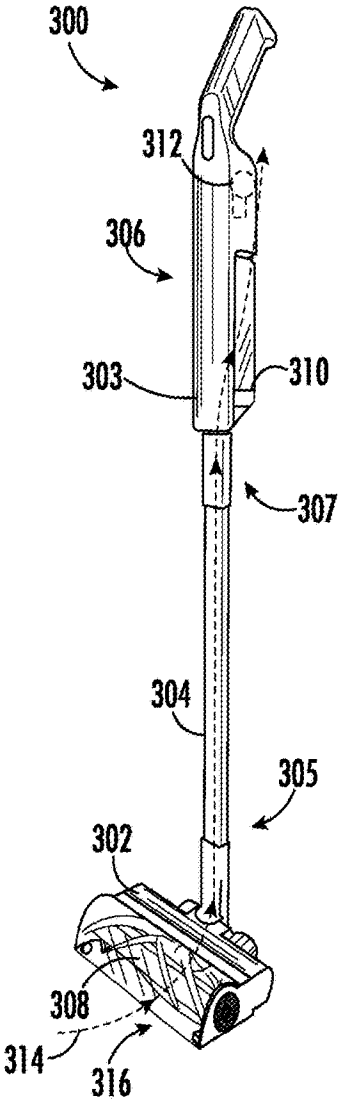
FIG. 3 is a perspective view of an example of a vacuum cleaner, consistent with embodiments of the present disclosure.

FIG. 3 shows a perspective view of a vacuum cleaner 300, which may be an example of the vacuum cleaner 100 of FIG. 1. As shown, the vacuum cleaner 300 includes a surface cleaning head 302, a wand 303 coupled to a wand extension 304, the wand 303 and wand extension 304 being fluidly coupled to the surface cleaning head 302, and a vacuum assembly 306 fluidly coupled to the wand 303. As shown, a first end 305 of the wand extension 304 can be coupled to the surface cleaning head 302 and a second end 307 of the wand extension 304 can be coupled to the wand 303. The surface cleaning head 302 includes one or more agitators 308 (e.g., brush rolls) configured to rotatably engage a surface to be cleaned (e.g., a floor). In some instances, the surface cleaning head 302 can include a power source (e.g., one or more batteries) configured to power one or more motors such that the one or more agitators 308 are rotated. Additionally, or alternatively, a power source (e.g., one or more batteries) may be included with, for example, the vacuum assembly 306. In instances where the vacuum cleaner 300 includes a plurality of power sources (e.g., one in the surface cleaning head 302 and one in the vacuum assembly 306) a docking station (see, e.g., FIG. 4) may include a plurality of charging points, each corresponding to a respective power source.

The vacuum assembly 306 includes a vacuum cleaner dust cup 310 and a suction motor 312 (shown schematically in hidden lines). The suction motor 312 is configured to cause air to be moved along a cleaning flow path 314. As shown, the cleaning flow path 314 extends from an air inlet 316 of the surface cleaning head 302 through the wand extension 304 and wand 303 into the vacuum cleaner dust cup 310 through the suction motor 312 and into a surrounding environment. In some instances, the one or more agitators 308 may be caused to rotate in response to air flowing along the cleaning flow path 314. For example, a pressure sensor may be included along the cleaning flow path 314 to detect a change in pressure (e.g., a generation of suction) along the cleaning flow path 314. Upon detecting a change in pressure, the pressure sensor may cause power to be transmitted to one or more motors configured to rotate the one or more agitators 308.

Figure 4:
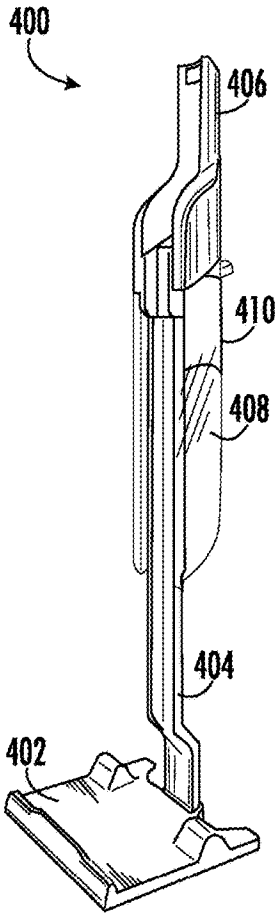
FIG. 4 is a perspective view of an example of a docking station configured to engage, for example, the vacuum cleaner of FIG. 3, consistent with embodiments of the present disclosure.

FIG. 4 shows a perspective view of a docking station 400, which may be an example of the docking station 200 of FIG. 2. As shown, the docking station 400 includes a base 402 configured to receive the surface cleaning head 302 of the vacuum cleaner 300, an upright section 404 extending from the base 402, a vacuum assembly receptacle 406 configured to receive (e.g., engage) at least a portion of the vacuum assembly 306, and a docking station dust cup 408 fluidly coupled to the vacuum assembly receptacle 406. The vacuum assembly receptacle 406 can be coupled to the upright section 404. For example, the base 402 and the vacuum assembly receptacle 406 may be coupled to the upright section 404 at opposing end regions of the upright section 404.

Figure 5:
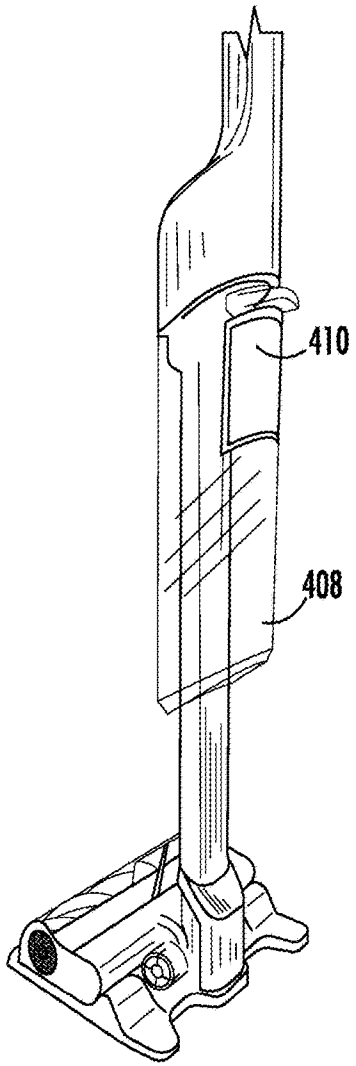
FIG. 5 is another perspective view of the docking station of FIG. 4, consistent with embodiments of the present disclosure.
Figure 6:
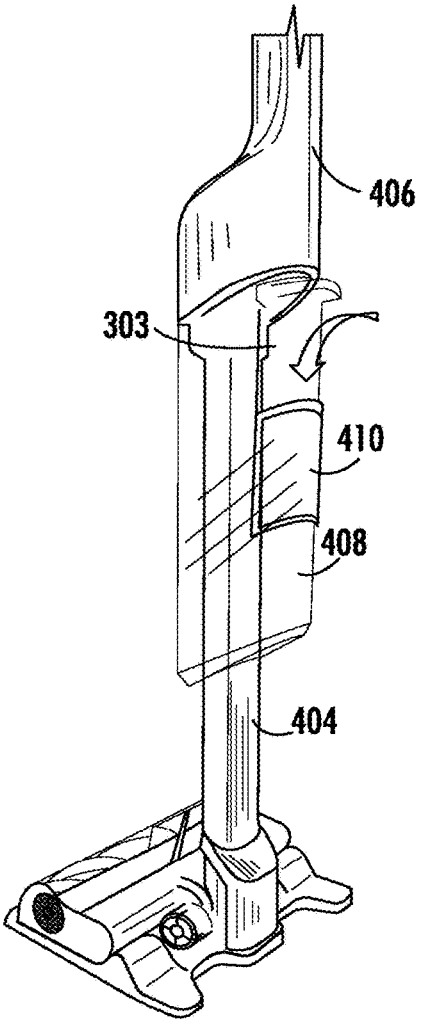
FIG. 6 is another perspective view of the docking station of FIG. 4, consistent with embodiments of the present disclosure.

The docking station dust cup 408 includes a dust cup hatch 410 configured to transition between a closed position (see FIG. 5) and an open position (see FIG. 6). The dust cup hatch 410 can be biased (e.g., using a spring) towards the closed position. When the dust cup hatch 410 is in the open position, a user of the docking station 400 can place debris into the docking station dust cup 408 for later disposal.

Figure 7:
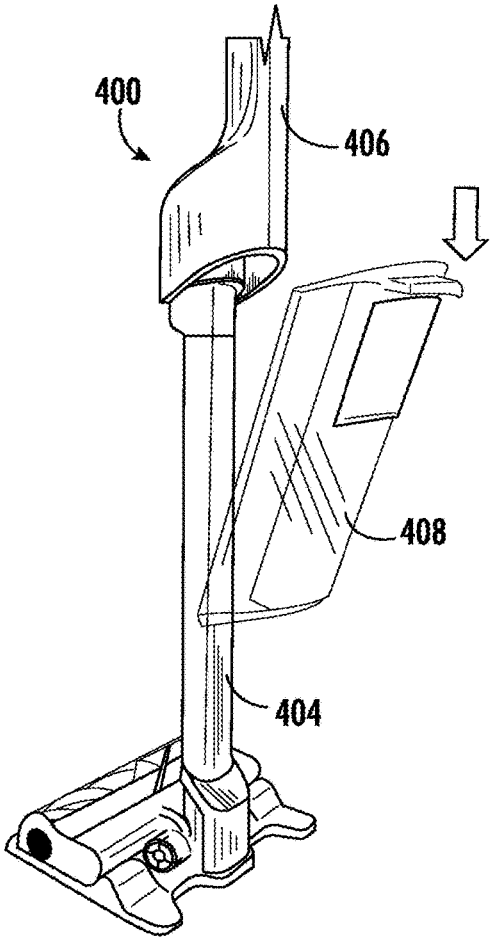
FIG. 7 is another perspective view of the docking station of FIG. 4, consistent with embodiments of the present disclosure.

As shown in FIG. 7, the docking station dust cup 408 can be removed from the docking station 400 such that the docking station dust cup 408 can be emptied. The docking station dust cup 408 can be configured to be removably coupled to a portion of the docking station 400 (e.g., the upright section 404 and/or the vacuum assembly receptacle 406) using, for example, a press-fit and/or snap-fit. Additionally, or alternatively, the docking station dust cup 408 can be configured to be removably coupled to the docking station 400 using, for example, an actuatable latch.

Figure 8:
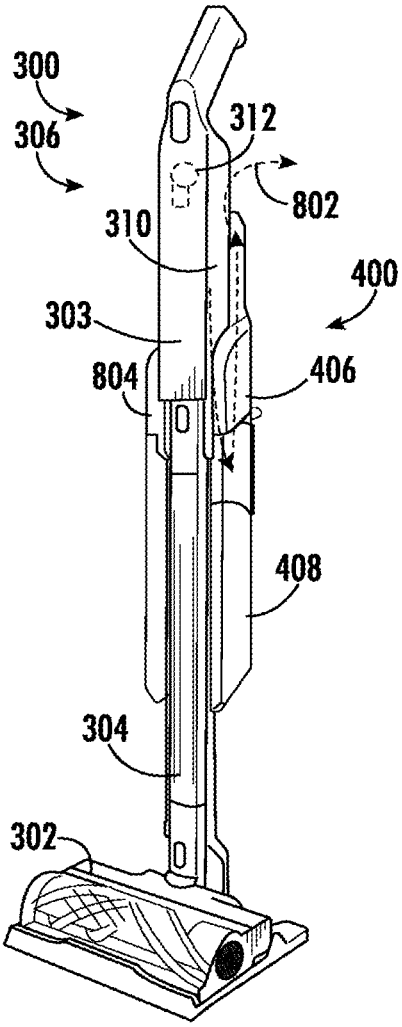
FIG. 8 is a perspective view of the docking station of FIG. 4 engaging the vacuum cleaner of FIG. 3, consistent with embodiments of the present disclosure.

FIG. 8 shows a perspective view of the vacuum cleaner 300 engaging the docking station 400. As shown, at least a portion of the vacuum assembly 306 is received by the vacuum assembly receptacle 406. The vacuum assembly receptacle 406 is configured to cause the cleaning flow path 314 to transition to an evacuation flow path 802. The evacuation flow path 802 bypasses the wand extension 304 and surface cleaning head 302 such that the vacuum cleaner dust cup 310 is fluidly coupled to the docking station dust cup 408. As such, the suction motor 312 can cause debris within the vacuum cleaner dust cup 310 to be urged into the docking station dust cup 408.

Figure 9:
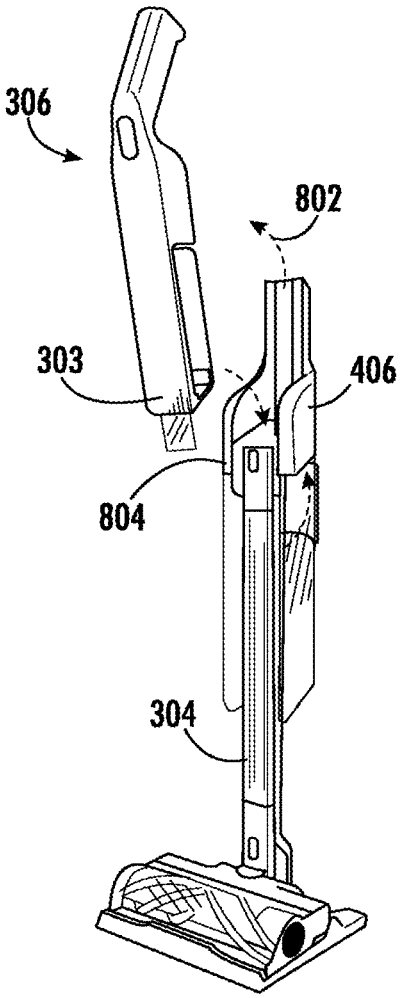
FIG. 9 is a perspective view of the docking station and vacuum cleaner of FIG. 8, wherein a vacuum assembly of the vacuum cleaner is decoupled from a wand extension and surface cleaning head of the vacuum cleaner, consistent with embodiments of the present disclosure.

The vacuum assembly receptacle 406 can include a release 804 configured to cause the vacuum assembly 306 to disengage the wand extension 304 and the vacuum assembly receptacle 406 (see FIG. 9). When disengaged from the wand extension 304, the vacuum assembly 306 can be coupled to one or more cleaning accessories (e.g., a crevice cleaning tool).

Figure 10:
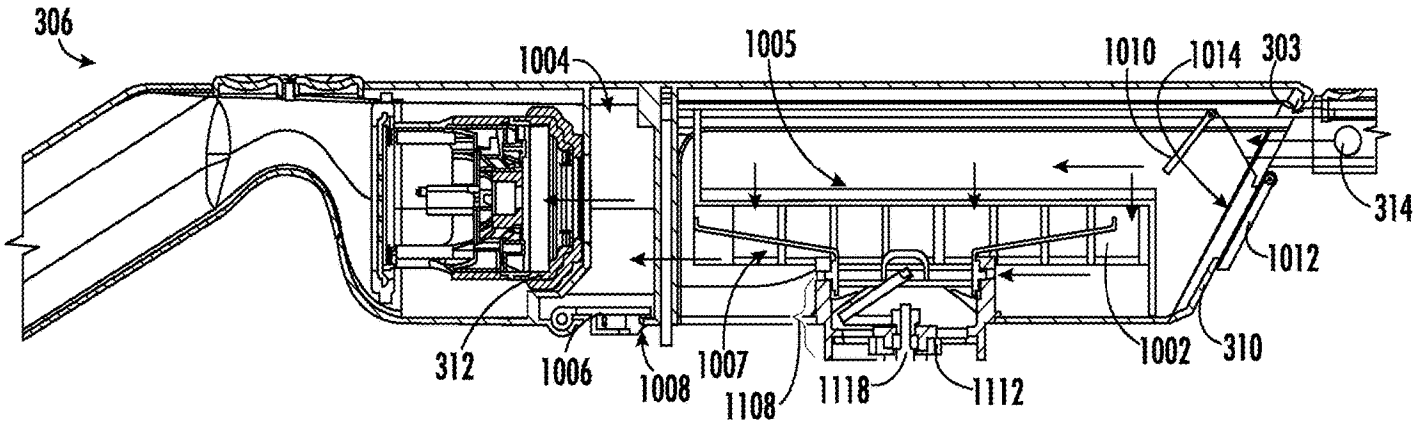
FIG. 10 is a cross-sectional view of a portion of the vacuum cleaner of FIG. 3, consistent with embodiments of the present disclosure.

FIG. 10 shows a cross-sectional view of an example of the vacuum assembly 306 and the wand 303 disengaged from the docking station 400. As shown, when disengaged from the docking station 400, air flows according to the cleaning flow path 314. The cleaning flow path 314 extends from the wand 303 into the vacuum cleaner dust cup 310 through a filter medium 1002 of the vacuum assembly 306 into a premotor chamber 1004 and through the suction motor 312. The filter medium 1002 may extend within or define a portion of the vacuum cleaner dust cup 310. As shown, air flowing through the filter medium 1002 according to the cleaning flow path 314 flows from a debris collection side 1005 of the filter medium 1002 to a clean side 1007 of the filter medium 1002. This may generally be referred to as a forward direction of air flow through the filter medium 1002. The filter medium 1002 may be a mesh filter, a high-efficiency particulate air (HEPA) filter, and/or any other type of filter.

Figure 11A:
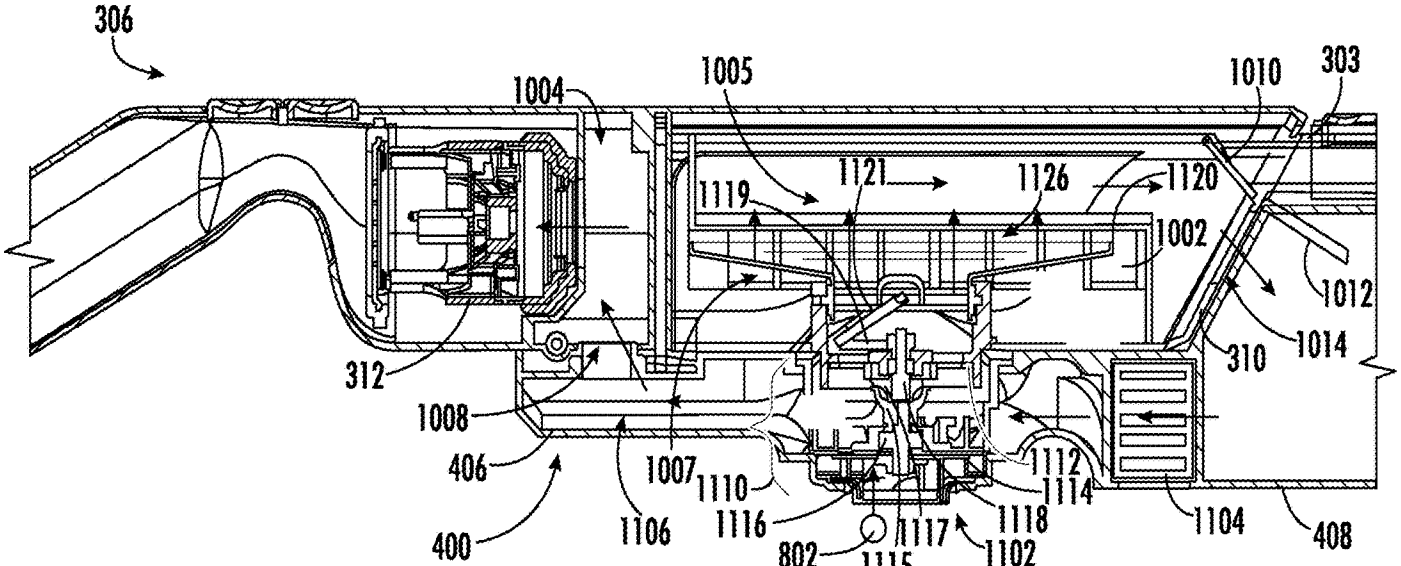
FIG. 11A is a cross-sectional view of a portion of the vacuum cleaner of FIG. 3 engaging the docking station of FIG. 4, consistent with embodiments of the present disclosure.
Figure 11C:
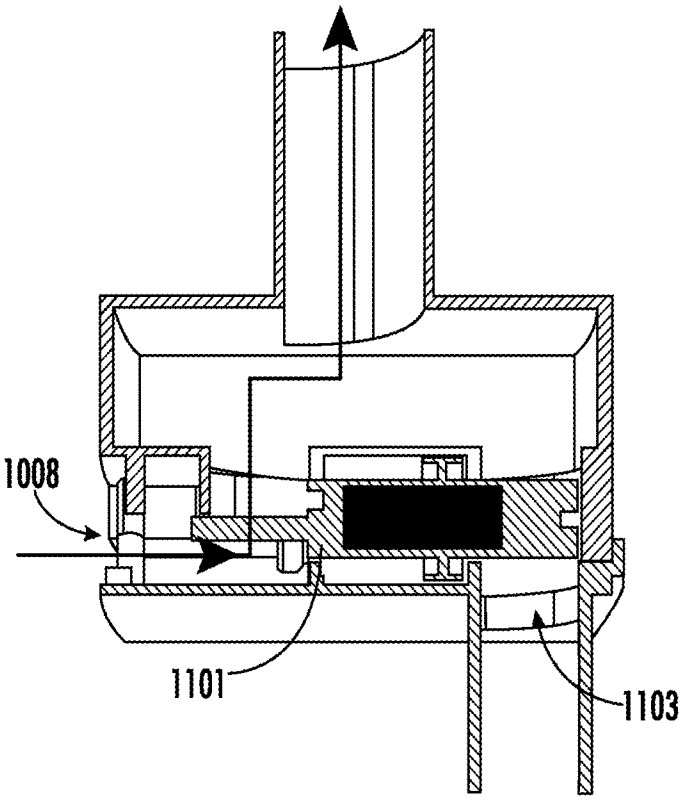
FIG. 11C shows an example of the actuatable valve of FIG. 11B in an evacuation position, consistent with embodiments of the present disclosure.
Figure 11B:
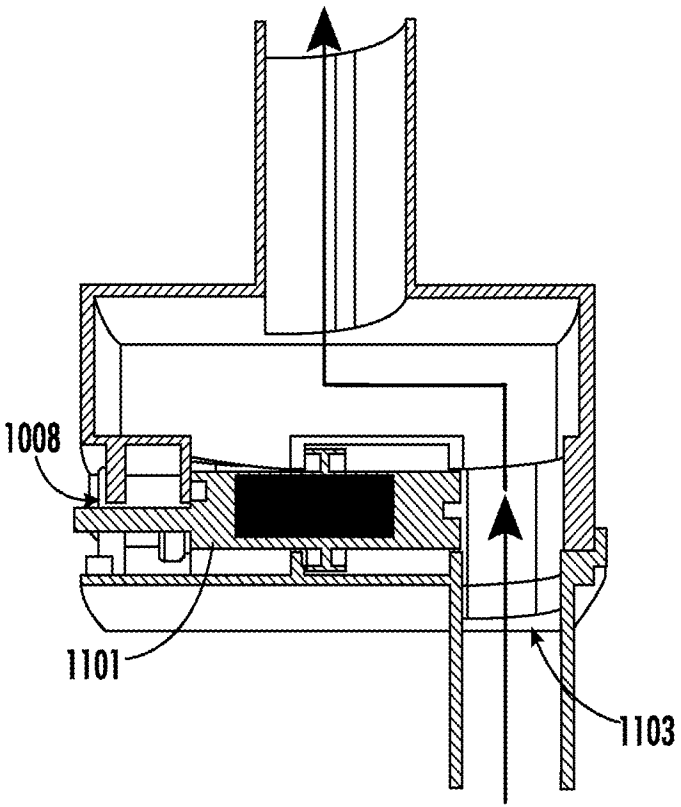
FIG. 11B shows an example of an actuatable valve in a cleaning position, consistent with embodiments of the present disclosure.

The premotor chamber 1004 includes a premotor chamber hatch 1006 configured to transition between a closed position (e.g., as shown in FIG. 10) and an open position (e.g., as shown in FIG. 11A). When in the closed position, air is substantially prevented from passing through a flow path adjustment opening 1008 and, when in the open position, air can pass through the flow path adjustment opening 1008. Additionally, or alternatively, an actuatable valve 1101 may be fluidly coupled to the flow path adjustment opening 1008 (see, e.g., FIGS. 11B and 11C). As shown in FIG. 11B, when the vacuum assembly 306 is disengaged from the docking station 400, the actuatable valve 1101 is in a cleaning position such that a dust cup opening 1103 is open and the flow path adjustment opening 1008 is closed. As shown in FIG. 11C, when the vacuum assembly 306 is engaging the docking station 400, the actuatable valve 1101 is in an evacuation position such that the dust cup opening 1103 is closed and the flow path adjustment opening 1008 is open. The actuatable valve 1101 may be biased towards the cleaning position such that, when the vacuum assembly 306 disengages the docking station 400, the actuatable valve 1101 transitions to the cleaning position.

As also shown, the vacuum cleaner dust cup 310 includes a wand hatch 1010. The wand hatch 1010 is configured to transition between an open position (e.g., as shown in FIG. 10) and a closed position (e.g., as shown in FIG. 11A). When in the open position, air can pass through the wand 303 and into the vacuum cleaner dust cup 310 and, when in the closed position, air is substantially prevented from passing through the wand 303 and into the vacuum cleaner dust cup 310. The vacuum cleaner dust cup 310 also includes an evacuation hatch 1012. The evacuation hatch 1012 is configured to transition between a closed position (e.g., as shown in FIG. 10) and an open position (e.g., as shown in FIG. 11A). When in the closed position, air is substantially prevented from passing through an evacuation opening 1014 and, when in the open position, air can pass through the evacuation opening 1014.

Figure 11E:
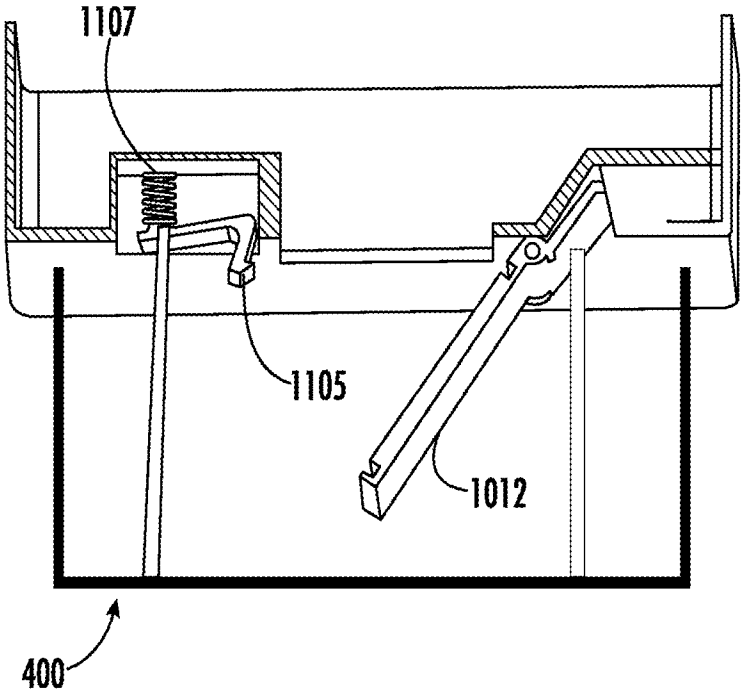
FIG. 11E shows a magnified schematic view of an example of the evacuation hatch of FIG. 11D in an open position, consistent with embodiments of the present disclosure.
Figure 11D:
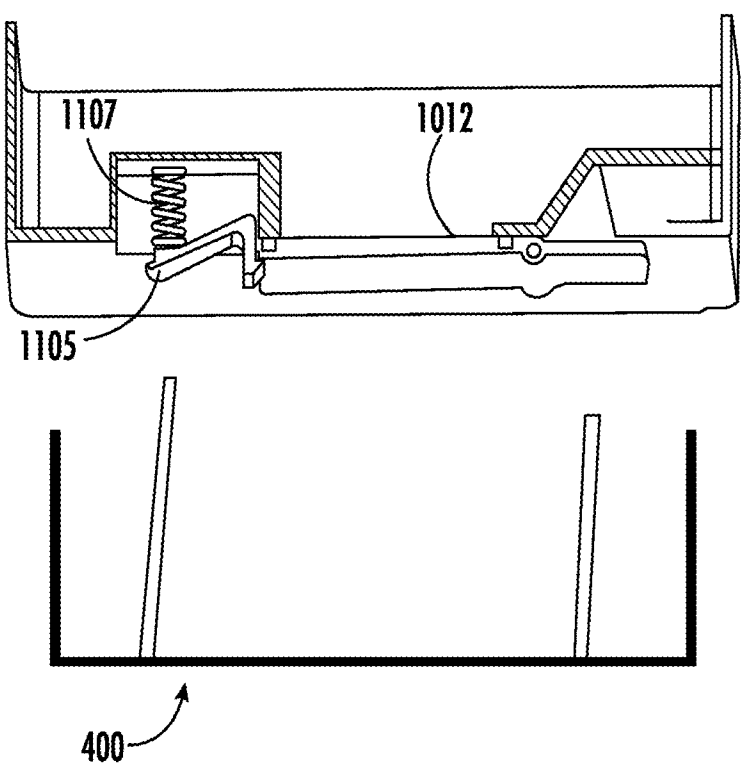
FIG. 11D shows a magnified schematic view of an example of an evacuation hatch in a closed position, consistent with embodiments of the present disclosure.

FIGS. 11D and 11E show a magnified schematic view of an example of the evacuation hatch 1012. As shown in FIG. 11D, the evacuation hatch 1012 may be retained in the closed position by an actuatable latch 1105. The actuatable latch 1105 can be biased towards a latching position using a latch biasing mechanism 1107 (e.g., a spring). As shown in FIG. 11E, the actuatable latch 1105 can be configured to be actuated in response to engaging the docking station 400 such that the evacuation hatch 1012 transitions to the open position. The evacuation hatch 1012 can be configured to transition to the open position in response to the evacuation hatch 1012 engaging the docking station 400. The evacuation hatch 1012 can be biased towards the closed position using a hatch biasing mechanism (e.g., a spring) such that, when the evacuation hatch 1012 disengages the docking station 400, the evacuation hatch 1012 is urged to the closed position.

Transitioning the premotor chamber hatch 1006, the wand hatch 1010, and the evacuation hatch 1012 between open and closed positions can cause the vacuum cleaner air flow path to transition between the cleaning flow path 314 and the evacuation flow path 802. For example, air may flow through the vacuum assembly 306 according to the cleaning flow path 314 when the premotor chamber hatch 1006 and evacuation hatch 1012 are in the closed position and the wand hatch 1010 is in the open position. By way of further example, air may flow through the vacuum assembly 306 according to the evacuation flow path 802 when the premotor chamber hatch 1006 and evacuation hatch 1012 are in the open position and the wand hatch 1010 is in the closed position.

FIG. 11A shows a cross-sectional view of an example of the vacuum assembly 306 and the wand 303 engaging to the docking station 400. As shown, when engaging the docking station 400, air flows according to the evacuation flow path 802. The evacuation flow path 802 extends from a bypass channel 1102 through the filter medium 1002 into the vacuum cleaner dust cup 310 and the docking station dust cup 408 through a docking station dust cup filter 1104 into a docking station duct 1106 and the premotor chamber 1004 and through the suction motor 312. As shown, air flowing through the filter medium 1002 according to the evacuation flow path 802 flows from the clean side 1007 of the filter medium 1002 to the debris collection side 1005 of the filter medium 1002. This may generally be referred to as a reverse direction of air flow through the filter medium 1002.

The bypass channel 1102 is configured to selectively fluidly couple the vacuum cleaner dust cup 310 to a surrounding environment. As such, when the bypass channel 1102 fluidly couples the vacuum cleaner dust cup 310 to the surrounding environment, the suction motor 312 causes air from the surrounding environment to be drawn into the vacuum cleaner dust cup 310 via the bypass channel 1102. Air drawn into the vacuum cleaner dust cup 310 via the bypass channel 1102 flows through the filter medium 1002 in the reverse direction. Such a configuration may cause at least a portion of any debris adhered to the debris collection side of 1005 of the filter medium 1002 to become unadhered (dislodged) from the debris collection side 1005 and become entrained in the air flowing along the evacuation flow path 802. At least a portion of debris entrained in the air may be deposited in the docking station dust cup 408.

The bypass channel 1102 may be at least partially defined in one or more of the vacuum assembly 306 and/or the docking station 400. As shown, the bypass channel 1102 is collectively defined by a vacuum assembly portion 1108 defined in the vacuum assembly 306 and a docking station portion 1110 defined in the vacuum assembly receptacle 406 of the docking station 400. The vacuum assembly portion 1108 of the bypass channel 1102 may include a valve 1112 configured to selectively fluidly couple the vacuum cleaner dust cup 310 to the surrounding environment. For example, the valve 1112 can be configured to transition from a closed position (e.g., as shown in FIG. 10) to an open position (e.g., as shown in FIG. 11A) in response to the vacuum cleaner 300 engaging the docking station 400.

Figure 12:
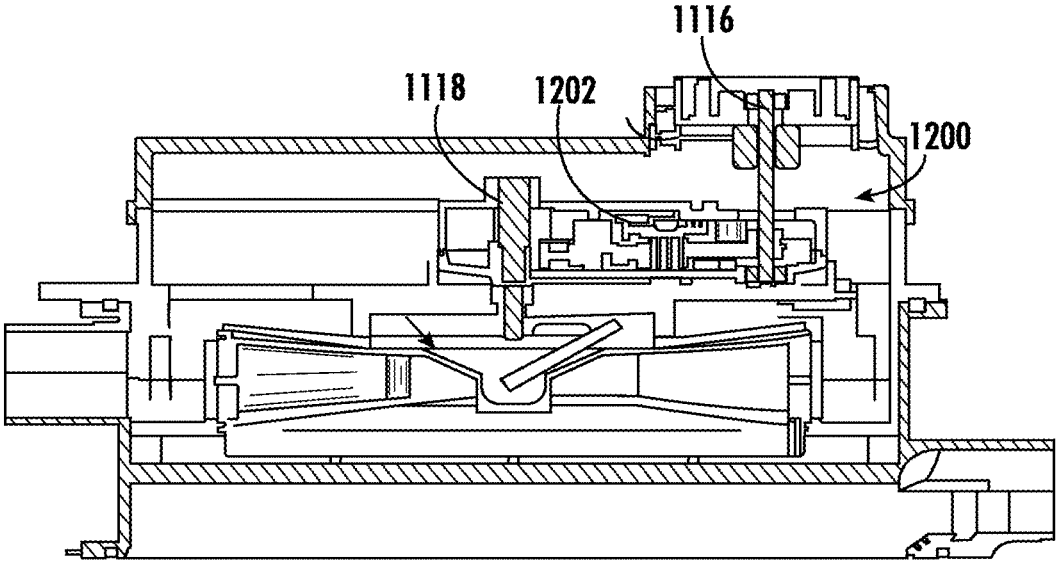
FIG. 12 is another cross-sectional view of a portion of the vacuum cleaner of FIG. 3 engaging the docking station of FIG. 4, consistent with embodiments of the present disclosure.

As shown, the bypass channel 1102 (e.g., the docking station portion 1110) includes a turbine 1114 configured to be rotated in response to air passing therethrough (e.g., air flowing along the evacuation flow path 802). The turbine 1114 can be coupled to a docking station drive shaft 1116 such that the docking station drive shaft 1116 rotates with the turbine 1114. The docking station drive shaft 1116 is configured to engage a vacuum assembly drive shaft 1118 when the vacuum cleaner 300 engages the docking station 400 such that the vacuum assembly drive shaft 1118 rotates with the docking station drive shaft 1116. For example, as shown in FIG. 11A, the vacuum assembly drive shaft 1118 and the docking station drive shaft 1116 can include corresponding friction couplings 1115 and 1117. By way of further example, as shown in FIG. 12, a drive train 1200 including a plurality of gears 1202 can rotationally couple the docking station drive shaft 1116 with the vacuum assembly drive shaft 1118. Rotation of the vacuum assembly drive shaft 1118 causes a wiper 1120 of the vacuum assembly 306 (e.g., the vacuum cleaner dust cup 310) to move relative to the filter medium 1002. For example, the wiper 1120 may be caused to oscillate through an oscillation angle (e.g., 45°, 90°, 135°, 180°, 225°, and/or any other angle). For example, the vacuum assembly drive shaft 1118 can be coupled to an oscillation arm 1119 such that the oscillation arm 1119 moves with the vacuum assembly drive shaft 1118. An oscillation bar 1121 can be coupled to the oscillation arm 1119 and the wiper 1120 such that the oscillation bar 1121 extends transverse to the oscillation arm 1119 and moves about the rotation axis of the vacuum assembly drive shaft 1118. As such, rotation of the oscillation bar 1121 causes the wiper 1120 to oscillate. In other words, the wiper 1120 may be generally described as being configured to move in response to a rotation of the turbine 1114.

Movement (e.g., oscillation) of the wiper 1120 relative to the filter medium 1002 may cause at least a portion of any debris adhered to the debris collection side 1005 of the filter medium 1002 to become unadhered from the debris collection side. The wiper 1120 may be spaced apart from the filter medium 1002 such that the wiper does not engage (e.g., contact) the filter medium 1002. For example, the wiper 1120 may be configured such that air can flow through a wiper channel 1122 defined therein. The wiper channel 1122 is fluidly coupled to the bypass channel 1102 such that air flowing along the evacuation flow path 802 flows through the bypass channel 1102 and the wiper channel 1122 before passing through the filter medium 1002 in the reverse direction. The wiper channel 1122 can be configured to increase a flow velocity of air flowing therethrough (e.g., a width of the wiper channel 1122 can decrease from a wiper channel inlet 1124 to a wiper channel outlet 1126). For example, an outlet width 1128 (see FIG. 13) of the wiper channel outlet 1126 may measure in a range of 1% to 25% of a filter width 1130 (see FIG. 13) of the filter medium 1002. The increased flow velocity of air exiting the wiper channel 1122 may better urge debris adhered to the debris collection side 1005 of the filter medium 1002 to become unadhered from the debris collection side 1005. Oscillation of the wiper 1120 may allow the wiper channel outlet 1126 to be small/narrow relative to the surface of the clean side 1007 of the filter medium 1002.

Figure 13:
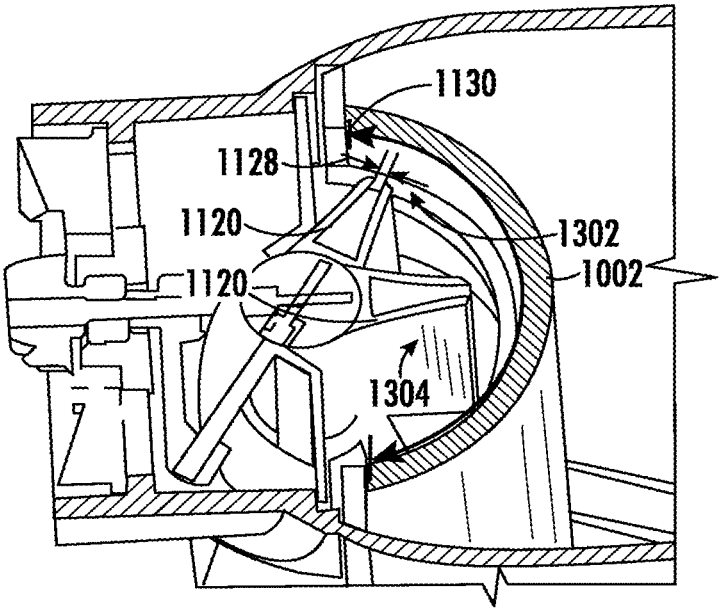
FIG. 13 is a cross-sectional view of a portion of the vacuum cleaner of FIG. 3 showing a wiper configured to move relative to a filter medium, consistent with embodiments of the present disclosure.

FIG. 13 shows a perspective cross-sectional view of the vacuum assembly 306. The wiper 1120 is shown in a first position 1302 and a second position 1304 for convenience of illustrating the oscillation.

Figure 14A:
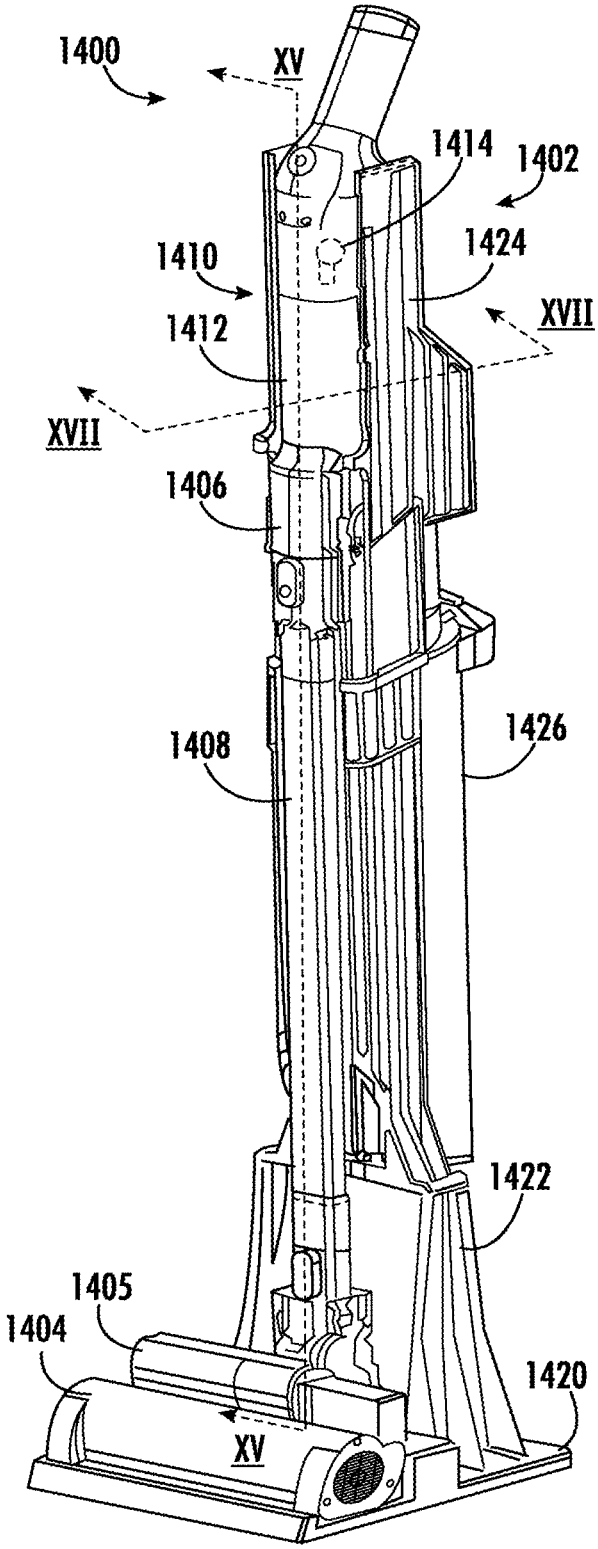
FIG. 14A is a perspective view of a vacuum cleaner engaging a docking station, consistent with embodiments of the present disclosure.

FIG. 14A shows a perspective view of a vacuum cleaner 1400 engaging a docking station 1402, which may be examples of the vacuum cleaner 100 of FIG. 1 and docking station 200 of FIG. 2, respectively. As shown, the vacuum cleaner 1400 includes a surface cleaning head 1404, a wand 1406 coupled to a wand extension 1408, the wand 1406 and wand extension 1408 being fluidly coupled to the surface cleaning head 1404, and a vacuum assembly 1410 fluidly coupled to the wand 1406. The vacuum assembly 1410 includes a vacuum cleaner dust cup 1412 and a suction motor 1414 (shown schematically in hidden lines). The surface cleaning head 1404 can include one or more agitators configured to be rotated by one or more motors. The one or more motors can be powered by a power source 1405 (e.g., one or more batteries). The power source 1405 may be included with the surface cleaning head 1404. Additionally, or alternatively, the wand extension 1408 and/or the vacuum assembly 1410 may include the power source 1405 (e.g., one or more batteries). In some instances, the one or more motors driving the one or more agitators may be powered in response to a pressure sensor detecting a pressure change generated by the starting of the suction motor 1414. In other words, the one or more agitators may be caused to rotate in response to a detected pressor change.

Figure 14B:
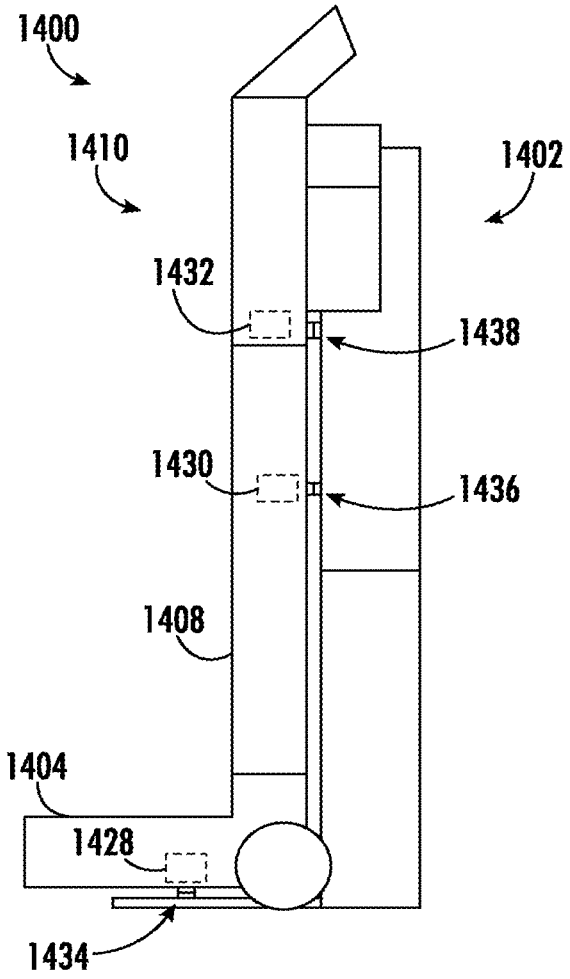
FIG. 14B is a schematic example of the vacuum cleaner engaging the docking station of FIG. 14A, consistent with embodiments of the present disclosure.

In some instances, the vacuum cleaner 1400 includes a plurality of power sources 1405 (e.g., one in the surface cleaning head 1404, one in the wand extension 1408, and/or one in the vacuum assembly 1410). In these instances, the docking station 1402 may include a plurality of charging contacts, wherein each power source 1405 has corresponding charging contacts. The charging contacts for each power source 1405 may be associated with a dedicated charging circuit. As such, each of the power sources 1405 can be independently recharged. Such a configuration may allow a remaining power level of each of the power sources 1405 to be considered when recharging the power sources 1405 such that, for example, one or more of the power sources 1405 are not over charged. FIG. 14B shows a schematic example of the vacuum cleaner 1400 and the docking station 1402, wherein the surface cleaning head 1404 includes a first power source 1428, the wand extension 1408 includes a second power source 1430, and the vacuum assembly 1410 includes a third power source 1432. The first, second, and third power sources 1428, 1430, and 1432 each correspond to respective charging contacts 1434, 1436, and 1438, wherein each of the charging contacts 1434, 1436, and 1438 are electrically coupled to respective charging circuits. As such, each of the first, second, and third power sources 1428, 1430, and 1432 can be independently recharged. As shown, the charging contacts 1434, 1436, and 1438 include a docking station half that is electrically coupled to a power supply of the docking station 1402 and a vacuum cleaner half that is electrically coupled to a respective one of the power sources 1428, 1430, and 1432. In some instances, a configuration, orientation, and/or position of at least a portion of the vacuum cleaner 1400 may be adjusted upon engaging the docking station 1402 such that an electrical coupling between respective halves of one or more of the charging contacts 1434, 1436, and/or 1438 can be made. The power sources 1428, 1430, and 1432 may be examples of the power source 1405.

Returning to FIG. 14A, as also shown, the docking station 1402 includes a base 1420 configured to receive the surface cleaning head 1404 of the vacuum cleaner 1400, an upright section 1422 extending from the base 1420, a vacuum assembly receptacle 1424 configured to receive at least a portion of the vacuum assembly 1410, and a docking station dust cup 1426 fluidly coupled to the vacuum assembly receptacle 1424. The docking station 1402 is configured to transition a vacuum cleaner flow path extending within the vacuum cleaner 1400 from a cleaning flow path 1500 (see FIG. 15) to an evacuation flow path (see FIG. 16).

Figure 15:
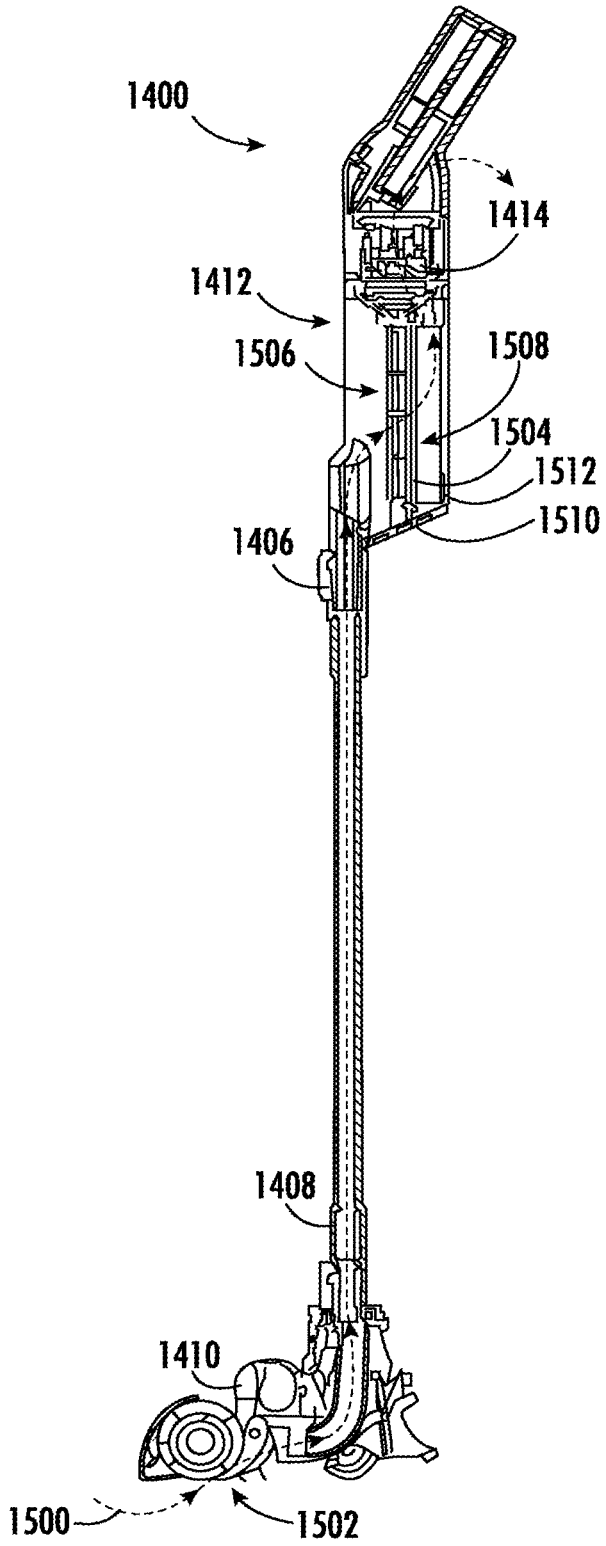
FIG. 15 is a cross-sectional view of the vacuum cleaner of FIG. 14A, consistent with embodiments of the present disclosure.

FIG. 15 shows a cross-sectional view of the vacuum cleaner 1400 disengaged from the docking station 1402 taken along the line XV-XV of FIG. 14A. As shown, the cleaning flow path 1500 extends from an inlet 1502 of the surface cleaning head 1404 through the wand extension 1408 and the wand 1406 into the vacuum cleaner dust cup 1412 through a filter medium 1504 and into the suction motor 1414. The cleaning flow path 1500 flows from a debris collection side 1506 of the filter medium 1504 to a clean side 1508 of the filter medium 1504. In other words, air can generally be described as flowing in a forward direction through the filter medium 1504 when moving along the cleaning flow path 1500. The filter medium 1504 may be a mesh filter, a high-efficiency particulate air (HEPA) filter, and/or any other type of filter.

As also shown, the vacuum cleaner dust cup 1412 can include a dust cup door 1510. The dust cup door 1510 can be configured to be pivotally coupled to a dust cup body 1512 such that the dust cup door 1510 can transition between an open and closed position. When in the open position, debris within the vacuum cleaner dust cup 1412 can be emptied therefrom.

Figure 16:
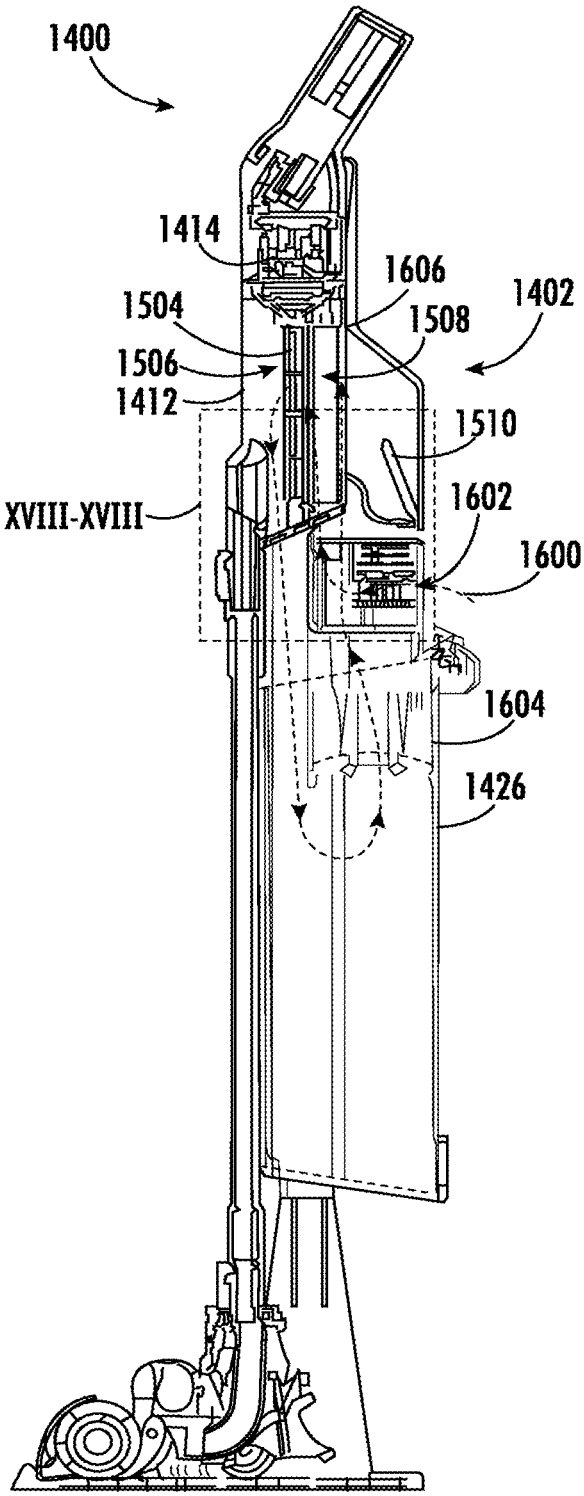
FIG. 16 is a cross-sectional view of the vacuum cleaner of FIG. 14A engaging the docking station of FIG. 14A, consistent with embodiments of the present disclosure.

FIG. 16 shows a cross-sectional view of the vacuum cleaner 1400 engaging the docking station 1402 taken along the line XV-XV of FIG. 14A. When the vacuum cleaner 1400 is engaging the docking station 1402, the cleaning flow path 1500 is transitioned to an evacuation flow path 1600. As shown, the evacuation flow path 1600 flows into a bypass channel 1602 through the filter medium 1504 into the vacuum cleaner dust cup 1412 and the docking station dust cup 1426 through a cyclonic separator 1604 of the docking station 1402 into a duct 1606 (see, also, FIG. 17) and through the suction motor 1414. The evacuation flow path 1600 extends through the filter medium 1504 from the clean side 1508 to the debris collection side 1506. In other words, air can generally be described as flowing in a reverse direction through the filter medium 1504 when moving along the evacuation flow path 1600. The duct 1606 may be closed when the vacuum cleaner 1400 disengages the docking station 1402, preventing air from flowing therethrough. For example, the dust cup door 1510 can extend over an opening to the duct 1606 preventing air from flowing through the duct 1606.

As shown, when the vacuum cleaner 1400 is engaging the docking station 1402, the dust cup door 1510 is pivoted to an open position (e.g., in response to the vacuum cleaner 1400 engaging docking station 1402). The dust cup door 1510 can be biased towards a closed position such that when the vacuum cleaner 1400 disengages the docking station 1402 the dust cup door 1510 is urged to the closed position. As such, the dust cup door 1510 can transition between the open and closed positions without a user having to directly manipulate the dust cup door 1510.

When in the open position, at least a portion of the dust cup door 1510 can be received within a portion of the docking station 1402 such that the vacuum cleaner dust cup 1412 is fluidly coupled with the docking station dust cup 1426. As such, when the dust cup door 1510 is in the open position debris contained within the vacuum cleaner dust cup 1412 may be deposited into the docking station dust cup 1426. When the suction motor 1414 is activated such that air moves along the evacuation flow path 1600, additional debris may become unadhered from the filter medium 1504 and be deposited in the docking station dust cup 1426.

Figure 17:
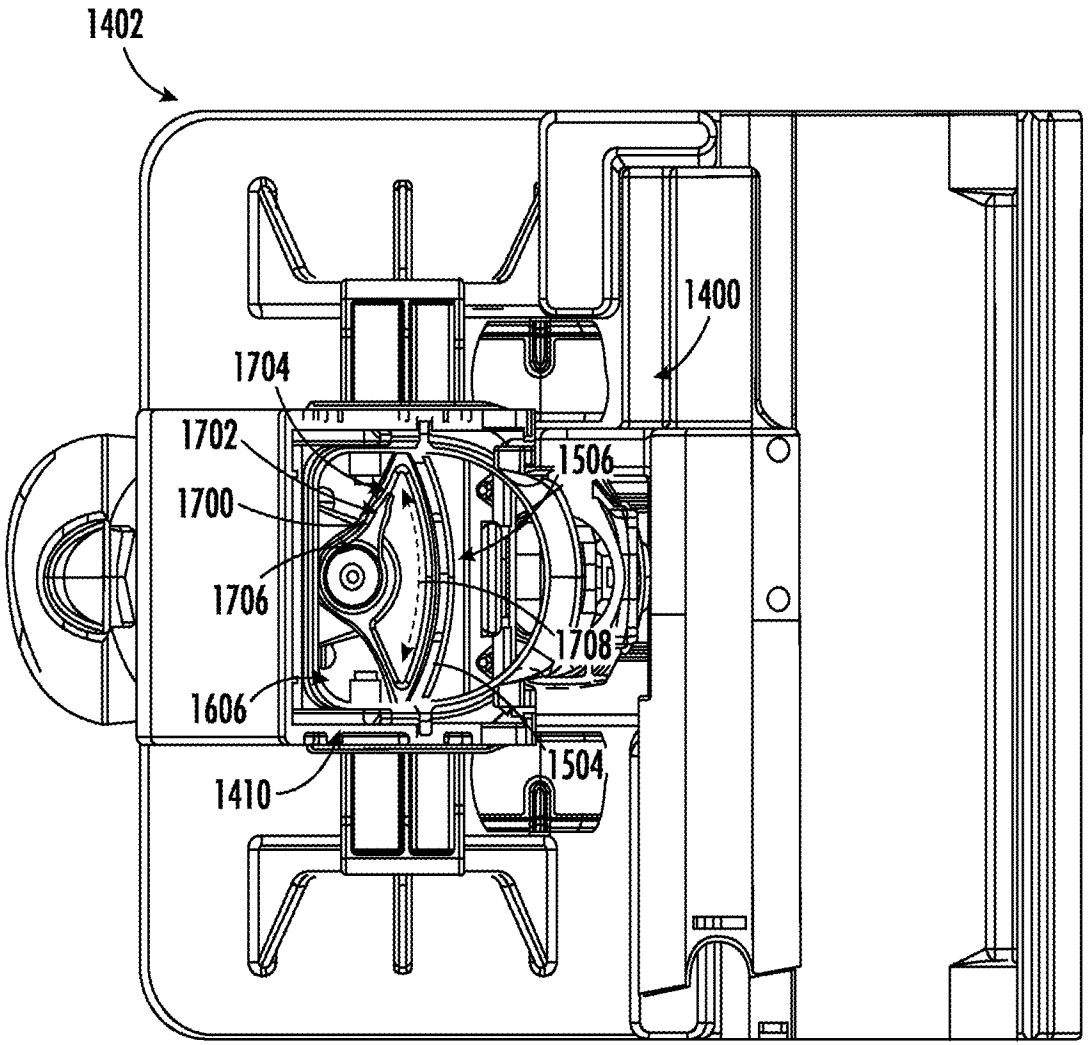
FIG. 17 is another cross-sectional view of the vacuum cleaner of FIG. 14A engaging the docking station of FIG. 14A, consistent with embodiments of the present disclosure.

FIG. 17 shows a cross-sectional view of the vacuum cleaner 1400 engaging the docking station 1402 taken along the line XVII-XVII of FIG. 14A. As shown, the vacuum cleaner 1400 can include a wiper 1700 configured to move relative to the filter medium 1504. The wiper 1700 can define a wiper channel 1702 through which air moving along the evacuation flow path 1600 moves. As shown, an outlet 1704 of the wiper channel 1702 has a width that measures narrower than an inlet 1706 of the wiper channel 1702. As such, a velocity of air moving along the evacuation flow path 1600 within the wiper channel 1702 increases towards the outlet 1704. The increased velocity may cause at least a portion of any debris adhered to a debris collection side 1506 of the filter medium 1504 to become unadhered from the debris collection side 1506 and become entrained in the air flowing moving the evacuation flow path 1600.

The wiper 1700 can be configured to move along an arcuate path 1708 that generally corresponds to an arcuate shape of the filter medium 1504. In some instances, the wiper 1700 can be configured to oscillate along the arcuate path 1708 when air is moving along the evacuation flow path 1600. In other instances, the wiper 1700 can be configured to move along the arcuate path 1708 only once when air is moving along the evacuation flow path 1600. In these instances, the wiper 1700 can be transitioned to a wiped position along the arcuate path 1708 in response to movement of air along the evacuation flow path 1600 and can be returned from the wiped position to a starting position along the arcuate path 1708 when air is no longer moving along the evacuation flow path 1600 and/or when at least a portion of the vacuum cleaner 1400 (e.g., the vacuum assembly 1410) is disengaged from the docking station 1402 (e.g., in response to a force exerted by a biasing mechanism such as a spring).

Figure 18:
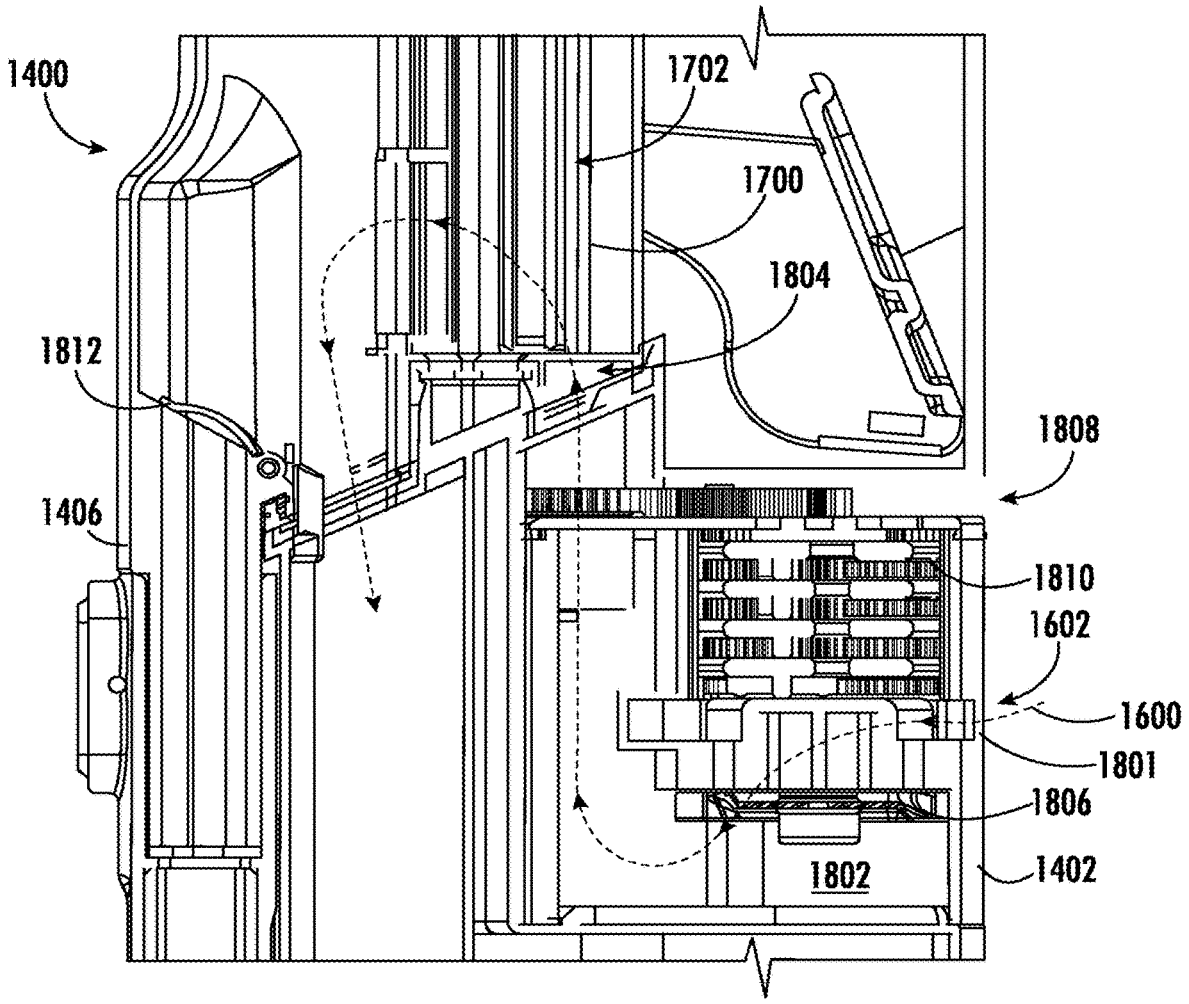
FIG. 18 is a magnified cross-sectional view of a portion of the vacuum cleaner of FIG. 14A engaging the docking station of FIG. 14A, consistent with embodiments of the present disclosure.

FIG. 18 is a magnified cross-sectional view that generally corresponds to the region XVIII-XVIII of FIG. 16. As shown, the bypass channel 1602 includes a first bypass portion 1802 defined in the docking station 1402, a second bypass portion 1804 defined in the vacuum cleaner 1400, and one or more bypass inlets 1801. The one or more bypass inlets may have a collective inlet area that measures, for example, in a range of 100 square millimeters ($mm^2$) to 500 $mm^2$. The first bypass portion 1802 includes at least one turbine 1806 configured to be rotated by air flowing along the evacuation flow path 1600. Rotation of the turbine 1806 causes a movement in the wiper 1700. The second bypass portion 1804 can fluidly couple the first bypass portion 1802 to the wiper channel 1702 such that air moving along the evacuation flow path 1600 can flow through the wiper channel 1702. In some instances, the second bypass portion 1804 can be configured to rotate with the wiper 1700.

As shown, the turbine 1806 can be coupled to a drive train 1808. The drive train 1808 can include a plurality of gears 1810 configured to transmit power from the turbine 1806 to the wiper 1700. For example, the plurality of gears 1810 may be planetary gears. The drive train 1808 can be configured to reduce the rotation speed of the wiper 1700 relative to the rotational speed of the turbine 1806.

Figure 19:
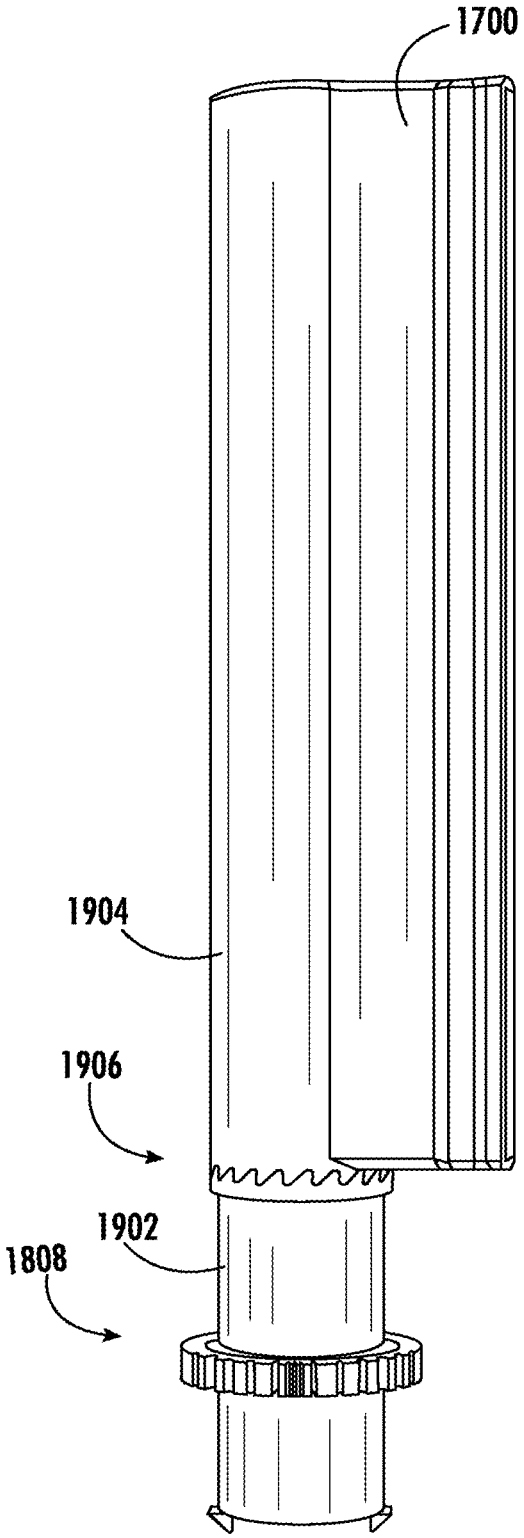
FIG. 19 shows a perspective view of a docking station drive shaft and a vacuum assembly drive shaft, consistent with embodiments of the present disclosure.

The drive train 1808 can be configured to drive a docking station drive shaft 1902 and a vacuum assembly drive shaft 1904 (see FIG. 19, showing the docking station drive shaft 1902 and the vacuum assembly drive shaft 1904 removed from vacuum cleaner 1400 and docking station 1402). As shown, the docking station drive shaft 1902 and vacuum assembly drive shaft 1904 include interlocking protrusions 1906 (e.g., teeth) configured to engage when the vacuum cleaner 1400 engages the docking station 1402. In instances when the wiper 1700 makes only a single pass over the filter medium 1504, the wiper 1700 may be biased towards a starting position by a biasing mechanism (e.g., a spring). When the interlocking protrusions 1906 disengage in response to the vacuum cleaner 1400 being disengaged from the docking station 1402, the biasing mechanism may urge the wiper 1700 towards the starting position.

As also shown, when the vacuum cleaner 1400 engages the docking station 1402, a wand hatch 1812 is transitioned to a closed position. When in the closed position, the wand hatch 1812 prevents and/or reduces air flowing through the wand 1406. As such, air moves along the evacuation flow path 1600. When the vacuum cleaner 1400 disengages the docking station 1402, the wand hatch 1812 can transition to an open position such that air can flow through the wand 1406.

Figure 20:
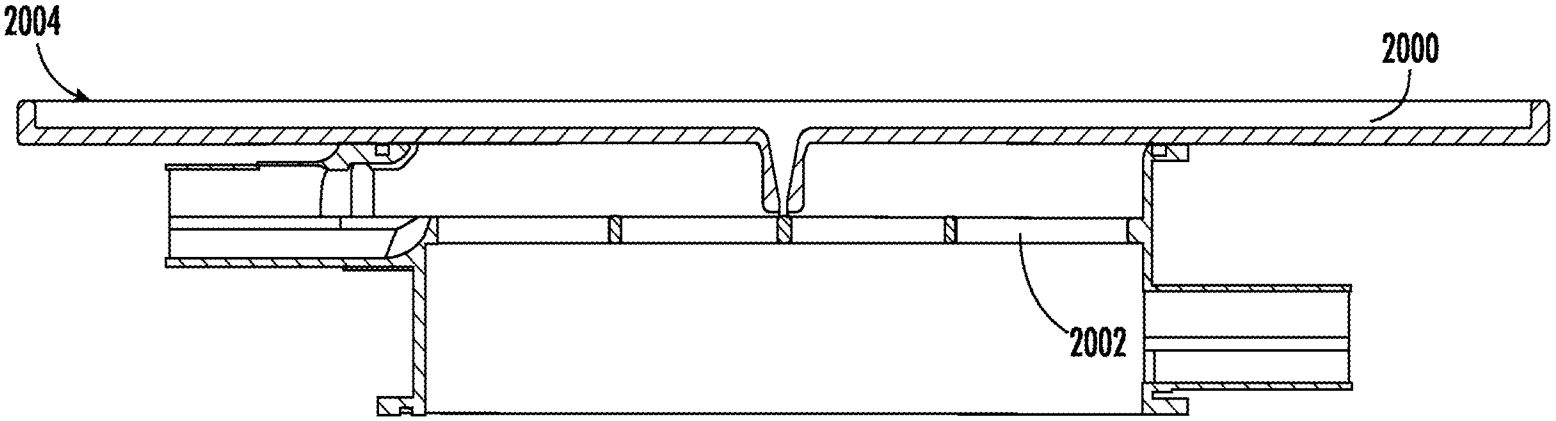
FIG. 20 is a perspective view of a wiper and a filter medium, consistent with embodiments of the present disclosure.

FIG. 20 shows a schematic example of a wiper 2000 configured move relative to a filter medium 2002 that can be configured to be used with any one or more of the vacuum cleaners disclosed herein. As shown, the filter medium 2002 is substantially planar. As such, the wiper 2000 can be configured to move linearly relative to the filter medium 2002. The wiper 2000 can be configured such that air can flow through a passageway 2004 defined therein.

An example of a docking station for a vacuum cleaner, consistent with the present disclosure, may include a receptacle configured to engage at least a portion of the vacuum cleaner such that, in response to engaging the receptacle, a vacuum cleaner flow path extending within the vacuum cleaner is transitioned from a cleaning flow path to an evacuation flow path, a suction motor of the vacuum cleaner being configured to urge air along the vacuum cleaner flow path and a docking station dust cup configured to receive debris from a vacuum cleaner dust cup of the vacuum cleaner.

In some instances, the docking station may further include a base and an upright section extending from the base, the receptacle being coupled to the upright section. In some instances, the receptacle may define at least a portion of a bypass channel, the evacuation flow path extending through the bypass channel. In some instances, the bypass channel may include a turbine configured to be rotated in response to air moving along the evacuation flow path. In some instances, rotation of the turbine may cause a wiper within the vacuum cleaner to move relative to a filter medium within the vacuum cleaner.

An example of a vacuum cleaner configured to engage a docking station, consistent with the present disclosure, may include a vacuum assembly configured such that, in response to the vacuum assembly engaging the docking station, a vacuum cleaner flow path extending within the vacuum assembly transitions from a cleaning flow path to an evacuation flow path. The vacuum assembly may include a vacuum cleaner dust cup and a suction motor configured to urge air along the vacuum cleaner flow path.

In some instances, the evacuation flow path may be configured such that air flowing along the evacuation flow path urges debris within the vacuum cleaner dust cup into a docking station dust cup of the docking station. In some instances, the vacuum assembly may include a filter medium. In some instances, the vacuum assembly may include a wiper, the wiper being configured to move relative to the filter medium. In some instances, the wiper may be configured to oscillate along an arcuate path, the arcuate path generally corresponding to a shape of the filter medium. In some instances, the wiper may define a wiper channel, the wiper channel being configured to increase a velocity of air flowing therethrough. In some instances, the evacuation flow path may extend through the wiper channel. In some instances, the wiper may be configured to move in response to a rotation of a turbine.

An example of a cleaning system may include a vacuum cleaner and a docking station. The vacuum cleaner may include a vacuum assembly. The vacuum assembly may include a vacuum cleaner dust cup and a suction motor configured to urge air along a cleaning flow path. The docking station may include a receptacle configured to engage at least a portion of the vacuum cleaner such that, in response to at least a portion the vacuum cleaner engaging the receptacle, the cleaning flow path is transitioned to an evacuation flow path, the suction motor being further configured to urge air along the evacuation flow path and a docking station dust cup configured to receive debris from the vacuum cleaner dust cup.

In some instances, the docking station may further include a base and an upright section extending from the base, the receptacle being coupled to the upright section. In some instances, the receptacle may define at least a portion of a bypass channel, the evacuation flow path extending through the bypass channel. In some instances, the bypass channel may include a turbine configured to be rotated in response to air moving along the evacuation flow path. In some instances, the vacuum assembly may include a filter medium and a wiper, the wiper being configured to move in response to rotation of the turbine. In some instances, the wiper may define a wiper channel, the wiper channel being configured to increase a velocity of air flowing therethrough. In some instances, the evacuation flow path may extend through the wiper channel.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner having a vacuum longitudinal axis extending lengthwise, the vacuum cleaner comprising:

an air inlet;

an air outlet;

an airflow pathway extending between the air inlet and the air outlet;

a motor operable to move air along the airflow pathway from the air inlet downstream toward the air outlet;

a debris separator arranged between the air inlet and the motor along the vacuum longitudinal axis, the debris separator comprising:

a debris collection chamber having a chamber longitudinal axis extending lengthwise parallel to the vacuum longitudinal axis;

a clean air chamber arranged downstream of and lateral to the debris collection chamber; and an elongate filter arranged parallel to the chamber longitudinal axis, the elongate filter extending coaxially with a longitudinal axis of the motor, the elongate filter laterally separating the debris collection chamber and the clean air chamber, wherein the elongate filter comprises an arcuate cross section including a first side facing the debris collection chamber and a second side downstream of the first side facing the clean air chamber, wherein the air flows from the first side of the elongate filter to the second side of the elongate filter along the airflow pathway to catch at least some of debris in the elongate filter;

a wiper configured to move relative to the elongate filter to dislodge debris from the elongate filter; and a battery.

2. The vacuum cleaner of claim 1, wherein the elongate filter comprises a mesh filter.

3. The vacuum cleaner of claim 1, wherein the wiper moves parallel to the chamber longitudinal axis to dislodge debris from the elongate filter.

4. The vacuum cleaner of claim 1, further comprising a cylindrical-shape, elongate handle, wherein when the vacuum cleaner is in a stored configuration where the vacuum longitudinal axis is perpendicular to a surface of a floor, the motor is arranged above the debris separator and the elongate handle is arranged above the motor.

5. The vacuum cleaner of claim 1, further comprising a wand, the wand including a wand longitudinal axis extending from a first end of the wand to a second end of the wand opposite the first end, the first end of the wand providing the air inlet, and the wand longitudinal axis parallel to the vacuum longitudinal axis and the chamber longitudinal axis.

6. The vacuum cleaner of claim 5, further comprising a surface cleaning head, wherein the surface cleaning head is removably couplable to the first end of the wand to fluidly connect the air inlet to the surface cleaning head.

7. The vacuum cleaner of claim 6, wherein the surface cleaning head comprises one or more rotatable agitators to engage a floor surface.

8. The vacuum cleaner of claim 7, wherein the one or more rotatable agitators are powered.

9. The vacuum cleaner of claim 1, wherein the elongate filter extends along more than half of a longitudinal length of the debris separator.

10. The vacuum cleaner of claim 1, wherein the elongate filter extends along substantially all of a longitudinal length of the clean air chamber.

11. A vacuum cleaner comprising:

a vacuum longitudinal axis extending lengthwise;

a debris separator arranged along the vacuum longitudinal axis, the debris separator comprising:

an air inlet;

a filter;

a dust cup; and a clean air chamber downstream of the dust cup, the filter laterally separating the dust cup and the clean air chamber, wherein the filter comprises an arcuate cross section including a debris collection side and a clean side downstream of the debris collection side, the debris collection side of the filter facing the dust cup and the clean side of the filter facing the clean air chamber;

a motor configured to urge air along an airflow pathway through the air inlet and the debris separator, wherein the airflow pathway flows from the debris collection side of the filter to the clean side of the filter such that at least some of debris is caught by the debris collection side, the motor positioned coaxially with a longitudinal axis of the filter along the vacuum longitudinal axis; and a wiper configured to dislodge debris from the debris collection side of the filter.

12. The vacuum cleaner of claim 11, further comprising a wand configured to couple to the air inlet at a first end of the wand, the wand comprising a longitudinal axis extending from the first end of the wand to a second end of the wand opposite the first end.

13. The vacuum cleaner of claim 12, further comprising a surface cleaning head configured to couple to the second end of the wand to fluidly connect the air inlet to the surface cleaning head.

14. The vacuum cleaner of claim 13, further comprising an elongate, cylindrical handle arranged at a first end of the vacuum cleaner opposite the surface cleaning head.

15. The vacuum cleaner of claim 14, wherein the elongate, cylindrical handle is arranged above the motor and the motor is arranged above the debris separator when vacuum longitudinal axis is oriented perpendicular to a floor surface and the surface cleaning head rests on the floor surface.

16. The vacuum cleaner of claim 15, wherein the elongate, cylindrical handle is angled relative to the longitudinal axis of the debris separator.

17. A vacuum cleaner for removing debris from a surface, the vacuum cleaner comprising:

an airflow within the vacuum cleaner from a dirty air inlet to a clean air outlet;

a front end proximate the dirty air inlet;

a rear end opposite the front end;

a surface cleaning head configured to removably couple to the front end to provide fluid communication between the surface cleaning head and the dirty air inlet;

an axially extending air treatment chamber partitioned into a debris collection side and a clean air side by a filtration assembly arranged parallel to a longitudinal axis of the air treatment chamber, the filtration assembly comprising a particulate filter and a mesh filter, the filtration assembly arranged downstream of and lateral to the debris collection side and upstream of and lateral to the clean air side, the filtration assembly axially extending along the air treatment chamber and including an arcuate cross section;

a suction motor operable to move air along the airflow, the particulate filter and the mesh filter extending coaxially with a longitudinal axis of the motor;

a wiper linearly movable along the filtration assembly to dislodge debris; and an axially extending handle proximate the rear end.

18. The vacuum cleaner of claim 17, further comprising a wand to couple the dirty air inlet to the surface cleaning head, the wand comprising a longitudinal axis extending from a first end of the wand to a second end of the wand opposite the first end, the longitudinal axis of the wand oriented parallel to the longitudinal axis of the air treatment chamber.

19. The vacuum cleaner of claim 17, wherein the filtration assembly extends along more than half of a longitudinal length of the air treatment chamber.

20. The vacuum cleaner of claim 17, wherein the filtration assembly extends along substantially all of a longitudinal length of the clean air side of the air treatment chamber.

* * * * *